US007665408B2

(12) United States Patent
Okazaki et al.

(10) Patent No.: US 7,665,408 B2
(45) **Date of Patent: *Feb. 23, 2010**

(54) SOLID FUEL BURNER, BURNING METHOD USING THE SAME, COMBUSTION APPARATUS AND METHOD OF OPERATING THE COMBUSTION APPARATUS

(75) Inventors: Hirofumi Okazaki, Hitachinaka (JP); Masayuki Taniguchi, Hitachinaka (JP); Toshikazu Tsumura, Kure (JP); Yoshitaka Takahashi, Hatsukaichi (JP); Kouji Kuramashi, Kure (JP)

(73) Assignees: Hitachi, Ltd., Tokyo (JP); Babcock-Hitachi K.K., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/633,489

(22) Filed: Dec. 5, 2006

(65) Prior Publication Data

US 2007/0079736 A1 Apr. 12, 2007

Related U.S. Application Data

(63) Continuation of application No. 11/011,047, filed on Dec. 15, 2004, now Pat. No. 7,168,374, which is a continuation of application No. 10/292,694, filed on Nov. 13, 2002, now Pat. No. 6,889,619.

(30) Foreign Application Priority Data

Nov. 16, 2001 (JP) ..... 2001-351746
Feb. 14, 2002 (JP) ..... 2002-037435

(51) Int. Cl.
*F23D 1/00* (2006.01)

(52) U.S. Cl. ..... 110/263; 110/265; 110/347

(58) Field of Classification Search ..... 431/9, 431/10, 181–183, 187, 284; 110/261–265, 110/347

See application file for complete search history.

(56) References Cited

U.S. PATENT DOCUMENTS 2,242,787 A * 5/1941 Lieberherr ..... 431/184

(Continued)

FOREIGN PATENT DOCUMENTS

EP 0 672 863 9/1995

(Continued)

*Primary Examiner*—Kenneth B Rinehart
(74) *Attorney, Agent, or Firm*—Crowell & Moring LLP

(57) ABSTRACT

A solid fuel burner using a low oxygen concentration gas as a transporting gas of a low grade solid fuel such as brown coal or the like and a combustion method using the solid fuel burner are provided. The solid fuel burner comprises a means for accelerating ignition of the fuel and a means for preventing slugging caused by combustion ash from occurring. Mixing of fuel and air inside a fuel nozzle 11 is accelerated by that an additional air nozzle 12 and a separator 35 for separating a flow passage are arranged in the fuel nozzle 11, and the exit of the additional air nozzle 12 is set at a position so as to overlap with the separator 35 when seeing from a direction perpendicular to a burner axis, and additional air is ejected in a direction nearly perpendicular to a flow direction of a fuel jet flowing through the fuel nozzle 11. An amount of air from the additional air nozzle 12 is varied corresponding to a combustion load. By increasing the amount of air from the additional air nozzle 12 at a low load operation, an oxygen concentration of a circulation flow 19 formed in a downstream portion outside the exit of the fuel nozzle 11 is increased to stably burn the fuel. By decreasing the amount of air from the additional air nozzle 12 at a high load operation, a flame is formed at a position distant from the fuel nozzle 11 to suppress radiant heat received by structures of the solid fuel burner and walls of the furnace.

7 Claims, 11 Drawing Sheets

U.S. PATENT DOCUMENTS

| | | | |
|---|---|---|---|
| 5,113,771 | A | 5/1992 | Rini et al. |
| 5,199,355 | A | 4/1993 | Larue |
| 5,321,937 | A | 6/1994 | Hamilton |
| 5,842,426 | A | 12/1998 | Ohta et al. |
| 5,934,899 | A | 8/1999 | Joshi et al. |
| 5,937,770 | A | 8/1999 | Kobayashi et al. |
| 6,189,464 | B1 | 2/2001 | Okazaki et al. |
| 6,237,510 | B1 | 5/2001 | Tsumura et al. |

FOREIGN PATENT DOCUMENTS

| | | | |
|---|---|---|---|
| EP | 0 809 068 | | 11/1997 |
| JP | 5-9084008 | | 5/1984 |
| JP | 10-037208 | | 8/1996 |
| JP | EP 0809068 | A2 * | 11/1997 |
| JP | 11-148610 | | 6/1999 |
| JP | 2000-038108 | | 2/2000 |

* cited by examiner

SOLID FUEL BURNER, BURNING METHOD USING THE SAME, COMBUSTION APPARATUS AND METHOD OF OPERATING THE COMBUSTION APPARATUS

CROSS-REFERENCE TO RELATED APPLICATIONS

This application is a continuation of U.S. patent application Ser. No. 11/011,047, filed Dec. 15, 2004, now U.S. Pat. No. 7,168,374 B2, issued Jan. 30, 2007, which is a continuation of Ser. No. 10/292,694, filed Nov. 13, 2002, now U.S. Pat. No. 6,889,619 B2, issued May 10, 2005, which claims priority to Japanese patent application Nos. 2001-351746, filed Nov. 16, 2001 and 2002-037435, filed Feb. 14, 2002.

BACKGROUND OF THE INVENTION

1. Field of the Invention

The present invention relates to a solid fuel burner for burning solid fuel by transporting the solid fuel using gas-flow, and particularly to a solid fuel burner suitable for pulverizing, transporting using gas-flow and then suspension-burning a fuel containing much moisture and volatile matters such as wood, peat, coal or the like, and a burning method using the solid fuel burner, a combustion apparatus comprising the solid fuel burner and a method of operating the combustion apparatus.

2. Description of Prior Art

Wood, peat and coal of a low coalification rank such as blown coal and lignite which are typical thereof contain much moisture. Further, classifying fuel components into volatile matters of a component released as gas when heated, char (fixed carbon) of a component remaining as solid, ash of a component remaining as incombustible matters and moisture, these fuels contain much moisture and volatile matters and a little char. Furthermore, these fuels are low in calorific value compared to coal of a high coalification rank such as bituminous coal and anthracite, and are generally low in grindability or pulverizability. In addition, these fuels have a property of low melting temperature of combustion ash.

Since these solid fuels contain much volatile matters, these solid fuels easily self-ignite in a storage process, a pulverizing process and a transportation process under air atmosphere, and accordingly are difficult to be handled compared to bituminous coal. In a case where these fuels are pulverized to be burned, a mixed gas of combustion exhaust gas and air reduced in the oxygen concentration is used as a transporting gas of the fuel in order to prevent these fuels from self-ig. The combustion exhaust gas reduces the oxygen concentration to suppress oxidation reaction (burning) of the fuel and to prevent the fuel from self-burning. On the other hand, the retention heat of the combustion exhaust gas has an effect of drying the fuel by evaporating the water in the fuel.

However, when the fuel is ejected from a solid fuel burner, the oxidation reaction of the fuel transported by the transporting gas of a low oxygen concentration is limited by the oxygen concentration around the fuel. Therefore, the combustion speed is slow compared to that in a case of fuel transported by air. Since the oxidation reaction of fuel is generally activated after the fuel is mixed with air ejected from the air nozzle, the combustion speed is determined by the mixing speed with the air. Therefore, complete burning time of the fuel is longer compared to complete burning time in a case of transporting the fuel using air, and accordingly an amount of unburned components at the exit of the combustion apparatus, that is, the furnace is increased. Further, the flame temperature is low because the combustion speed is slow. As the result, the reduction reaction of nitrogen oxides NOx to nitrogen activated in a Nox reducing zone of high temperature (about 1000 C.° or higher) is difficult to be used, and accordingly the concentration of NOx at the exit of the furnace becomes higher compared to the case of transporting the fuel using air.

As the method of accelerating ignition of fuel transported by a transporting gas of low oxygen concentration, there is a method that an additional air nozzle is provided in the front end of a fuel nozzle to increase the oxygen concentration in the fuel transporting gas. For example, a solid fuel burner comprising an additional air nozzle outside the fuel nozzle is disclosed in Japanese Patent Application Laid-Open No. 10-732208.

Further, Japanese Patent Application Laid-Open No. 11-148610 discloses a solid fuel burner which accelerates mixing of fuel and air at the exit of the fuel nozzle by arranging an additional air nozzle in the center of the fuel nozzle.

SUMMARY OF THE INVENTION

Each of the conventional solid fuel burner described above accelerates the combustion reaction by arranging the additional air nozzle inside of the fuel nozzle to accelerate mixing of the solid fuel with air. In this case, it is preferable that the fuel jet composed of the mixed fluid of the solid fuel and the transporting gas of the solid fuel is sufficiently mixed with the air ejected from the additional air nozzle at the exit of the fuel nozzle.

However, when the air ejected from the additional air nozzle is ejected in parallel to the direction of the fuel jet, the mixing between the fuel jet and the additional air becomes slow because the speed difference between the fuel jet and the additional air flow is small.

In general, the distance from the exit of the additional air nozzle to the exit of the fuel nozzle is shorter than 1 m. The flow speed of the fuel jet is higher than approximately 12 m/s. Therefore, the mixing time of the fuel particles with the additional air is as short as approximately 0.1 second or less, and accordingly the fuel particles can not be sufficiently mixed with the air.

On the other hand, in a case where the additional air nozzle is arranged upstream of the fuel nozzle in order to increase the mixing time of the fuel particles and the additional air in the fuel nozzle, there is possibility of occurrence of what is called a back-fire phenomenon in which ignition occurs inside the fuel nozzle. Therefore, the distance from the exit of the additional air nozzle to the exit of the fuel nozzle can not be lengthened.

On the other hand, if part of the additional air is ejected through a tapered injection portion toward the diagonally downstream direction, as described in Japanese Patent Application Laid-Open No. 11-148610, the additional air is difficult to reach the outer peripheral portion of the fuel nozzle.

An object of the present invention is to provide a solid fuel burner using a low oxygen concentration gas as a transporting gas of a low grade solid fuel such as brown coal or the like, which comprises a means for accelerating mixing between fuel particles and air inside a fuel nozzle and forming a zone having a fuel concentration and an oxygen concentration higher than average values of a fuel concentration and an oxygen concentration in the fuel nozzle to stably burn the fuel over a wide range from a high load condition to a low load condition without changing a distance from an exit of an additional air nozzle to an exit of a fuel nozzle.

Another object of the present invention is to provide a burning method using the solid fuel burner comprising the means for accelerating mixing between fuel particles and air to stably burn the fuel, a combustion apparatus comprising the solid fuel burner and a method of operating the combustion apparatus.

In order to attain the above objects, the present invention proposes a solid fuel burner comprising a fuel nozzle for ejecting a mixed fluid of a solid fuel and a transporting gas; an additional air nozzle for ejecting air into the fuel nozzle in a direction nearly perpendicular to a flow direction of the mixed fluid; and at least one outer-side air nozzle for ejecting air, the outer-side air nozzle being arranged outside of the fuel nozzle, wherein the exit of the additional air nozzle is arranged at a position in the burner upstream of an exit of the fuel nozzle.

The additional air nozzle may be arranged in the central portion of the fuel nozzle, or may be arranged in a separation wall portion for separating the fuel nozzle from the outer-side air nozzle.

It is also possible to employ a burning method using the solid fuel burner that when a combustion load is low, an amount of air supplied from the additional air nozzle is increased, and an amount of air supplied from the outer-side air nozzle closest to a fuel nozzle among the outer-side air nozzles is decreased or a swirling speed is increased; and when a combustion load is high, the amount of air supplied from the additional air nozzle is decreased, and the amount of air supplied from the outer-side air nozzle closest to the fuel nozzle among the outer-side air nozzles is increased or a swirling intensity is decreased.

The solid fuel burner in accordance with the present invention is a solid fuel burner comprising a fuel nozzle for ejecting a mixed fluid of a solid fuel and a transporting gas; an additional air nozzle for ejecting air into the fuel nozzle in a direction nearly perpendicular to a flow direction of the mixed fluid; and at least one outer-side air nozzle for ejecting air, the outer-side air nozzle being arranged outside of the fuel nozzle, wherein the exit of the additional air nozzle is arranged at a position in the burner upstream of an exit of the fuel nozzle.

The additional air nozzle may be arranged in the central portion of the fuel nozzle, or in the separation wall of the outer-side air nozzle.

When the additional air jet ejected from the additional air nozzle is ejected nearly perpendicular to the direction of the fuel jet, the mixing between the fuel jet and the additional air is progressed because the speed difference between the fuel particles and the additional air jet is larger than the speed difference in the case where the additional air jet ejected from the additional air nozzle is ejected in parallel to the direction of the fuel jet. Particularly, since the specific density of the fuel particle is larger than that of gas, the fuel particles are mixed into the additional air jet by an inertia force.

At that time, since the low oxygen concentration transporting gas around the fuel particles is separated from the fuel particles, the oxygen concentration around the fuel particles becomes higher than the oxygen concentration of the transporting gas. Therefore, after ejected from the fuel nozzle, the combustion reaction is accelerated by the high oxygen concentration, and accordingly flame is stably formed at the exit of the fuel nozzle.

At that time, by ejecting air from the additional air nozzle toward the direction nearly perpendicular to the flow direction of the fuel jet to increase the oxygen concentration along the outer partition wall inner periphery of the fuel nozzle, a high fuel concentration and high oxygen concentration region is formed along the outer partition wall inner periphery of the fuel nozzle. As the result, after ejected from the fuel nozzle, combustion reaction is progressed by the high oxygen concentration to stably form a flame at the exit of the fuel nozzle.

The pulverized coal flowing along near the inner wall surface of the fuel nozzle is increased to have a chance to be in contact with the air ejected from the outer-side air nozzle near the exit of the fuel nozzle. Further, the pulverized coal is apt to be ignited in contact with a high temperature gas of a circulation flow formed in the downstream side of a flame stabilizing ring to be described later.

The additional air nozzle may eject air from the separation wall in the periphery toward the center, or may eject air from the inner portion of the fuel nozzle toward the outer side.

The additional air nozzle is preferable arranged at the portion where the flow passage of the fuel nozzle expands. The inertia force of the fuel particles is strong compared to the inertia force of a gas. By arranging the exit of the additional air nozzle in the flow passage expanding portion where the velocity component from the flow passage toward the wall surface is hardly induced, it is possible to suppress the fuel particles to enter into or be accumulated in the additional air nozzle.

Further, the present invention proposes a solid fuel burner comprising a fuel nozzle for ejecting a mixed fluid of a solid fuel and a transporting gas; at least one air nozzle for ejecting air, the air nozzle being arranged outside the fuel nozzle; an additional air nozzle for ejecting air into the fuel nozzle in a direction nearly perpendicular to a flow direction of the mixed fluid; and a separator for dividing a flow passage, the separator being arranged in the fuel nozzle, wherein the transporting gas is a gas having an oxygen concentration lower than the oxygen concentration of air, and an exit of the additional air nozzle is in a position where the exit overlaps with the separator when the exit is seen from a direction vertical to an axis of the burner.

It is possible to provide an obstacle inside the fuel nozzle, the obstacle being composed of a portion contracting and a portion expanding the cross-sectional area of a flow passage inside the fuel nozzle, the portions being arranged in order of the contracting portion and the expanding portion from an upstream side of the burner.

In an end portion upstream of the separator in the flow passage of the fuel nozzle divided by the separator, a cross-sectional area of the flow passage in the side of arranging the additional air nozzle may be made larger than a cross-sectional area of the flow passage contracted by the obstacle.

The additional air nozzle is sometimes arranged in an outer separation wall portion of the fuel nozzle.

It is possible that the separator is formed of a cylindrical or a tapered thin plate structure, and the solid fuel burner comprises a flow passage contracting member upstream of the separator, the flow passage contracting member contracting the flow passage from the outer peripheral side of the fuel nozzle; and a concentrator downstream of the flow passage contracting member, the concentrator contracting the flow passage from the side of the center axis of the fuel nozzle.

In any one of the solid fuel burners described above, the solid fuel burner may comprises an obstacle in a front end of a separation wall for separating said fuel nozzle and the air nozzle, the obstacle blocking a flow of the solid fuel and the transporting gas of the solid fuel ejected from the fuel nozzle and a flow of the air ejected from the air nozzle. The obstacle is sometimes a toothed flame stabilizing ring arranged on a wall surface in the exit of the fuel nozzle.

A swirler may be arranged in the air nozzle.

A guide for determining a direction of ejecting air may be arranged in the exit of the air nozzle.

In these burning methods using the solid fuel burner, it is possible to employ the burning method using the solid fuel burner that when a combustion load is low, an amount of air supplied from the additional air nozzle is increased; and when the combustion load is high, the amount of air supplied from the additional air nozzle is decreased.

Sometimes employed is a burning method using the solid fuel burner, in which when a combustion load is low, an amount of air supplied from the additional air nozzle is increased and a flow rate of air supplied from the air nozzle is decreased, and when a combustion load is high, the amount of air supplied from the additional air nozzle is decreased and the flow rate of air supplied from the air nozzle is increased, whereby the ratio of the amount of air to the amount of fuel supplied from the solid fuel burner is kept constant.

It is possible to employ the burning method using the solid fuel burner, in which at the exit cross-section of the fuel nozzle, a zone having a fuel concentration and an oxygen concentration both higher than average values of a fuel concentration and an oxygen concentration is formed in the central zone or the peripheral zone; and a zone having a fuel concentration and an oxygen concentration both lower than the average values of the fuel concentration and the oxygen concentration is formed in the peripheral zone or the central zone, respectively. For example, in a case where the air nozzle is arranged in the outer periphery of the fuel nozzle, it is preferable that at the exit cross-section of the fuel nozzle, an outer peripheral zone having a fuel concentration and an oxygen concentration both higher than average values of a fuel concentration and an oxygen concentration is formed, respectively; and a central zone having a fuel concentration and an oxygen concentration both lower than the average values of the fuel concentration and the oxygen concentration is formed, respectively.

Further, the present invention proposes a combustion apparatus, which comprises a furnace having a plurality of any one kind of the solid fuel burners described above, a hopper, a coal feeder, a pulverizer fed with fuel which is mixed with combustion exhaust gas extracted from an upper portion of the combustion apparatus and inside a combustion exhaust gas pipe downstream of the coal feeder, a fuel pipe for feeding fuel pulverized by the pulverizer to the solid fuel burners, and a blower for supplying air to the solid fuel burners.

Furthermore, the present invention proposes a combustion apparatus, which comprises a furnace having a plurality of any one kind of the solid fuel burners described above; a hopper; a coal feeder; a pulverizer fed with fuel which is mixed with combustion exhaust gas extracted from an upper portion of the combustion apparatus and inside a combustion exhaust gas pipe downstream of the coal feeder; a fuel pipe for feeding fuel pulverized by the pulverizer to the solid fuel burners; a blower for supplying air to the solid fuel burners; a low load flame detector or a thermometer or a radiation pyrometer for monitoring a flame formed in each of the solid fuel burners under a low load condition; a high load flame detector or a thermometer or a radiation pyrometer for monitoring flames formed in a position distant from the solid fuel burners under a high load condition; and control means for controlling supplied an amount of the air ejected from the additional air nozzle based on a signal from the measurement instruments.

A method of operating the combustion apparatus employed is that when the combustion apparatus is operated with a high combustion load, the flame of the solid fuel is formed in a position distant from the solid fuel burner; and when the combustion apparatus is operated with a low combustion load, the flame of the solid fuel is formed in a position just after the exit of the fuel nozzle of the solid fuel burner.

The present invention proposes a boiler plant, which comprises a furnace having a plurality of any one kind of the solid fuel burners described above on wall surfaces; and a heat exchanger for generating steam by heating water using combustion heat generated by combustion of the solid fuel in the furnace, the heat exchanger being arranged on the walls of the furnace and inside the furnace.

The solid fuel burner in accordance with the present invention is particularly suitable for a case where a transporting gas has an oxygen concentration lower than 21% when a solid fuel containing much mpoisture and volatile matters such as blown coal, lignite or the like, wood or peat is pulverized, transported using fluid flow and suspension-burned.

The solid fuel burner in accordance with the present invention is a solid fuel burner comprising a fuel nozzle for ejecting a mixed fluid of a solid fuel and a transporting gas; at least one air nozzle for ejecting air, the air nozzle being arranged outside the fuel nozzle; an additional air nozzle for ejecting air into the fuel nozzle in a direction nearly perpendicular to a flow direction of the mixed fluid; and a separator for dividing a flow passage, the separator being arranged in the fuel nozzle, wherein the transporting gas is a gas having an oxygen concentration lower than the oxygen concentration of air, and an exit of the additional air nozzle is in a position where the exit overlaps with the separator when the exit is seen from a direction vertical to an axis of the burner.

The additional air nozzle may be arranged in the central portion of the fuel nozzle, or in the separation wall of the outer-side air nozzle. From the viewpoint of preventing abrasion caused by the fuel particles, it is preferable that the additional air nozzle is arranged on the separation wall of the fuel nozzle.

When the additional air jet ejected from the additional air nozzle is ejected nearly perpendicular to the direction of the fuel jet, the mixing between the fuel jet and the additional air is progressed because the speed difference between the fuel particles and the additional air jet is larger than the speed difference in the case where the additional air jet ejected from the additional air nozzle is ejected in parallel to the direction of the fuel jet. Particularly, since the specific density of the fuel particle is larger than that of air, the fuel particles are mixed into the additional air jet by an inertia force.

In the present invention, since an exit of the additional air nozzle is in the position where the exit overlaps with the separator when the exit is seen from the direction vertical to the axis of the burner, the additional air jet ejected from the additional air nozzle is mixed into only the flow passage in the additional air side interposed between the additional air nozzle and the separator in the fuel nozzle because the separator obstacles the flow. Since the additional air jet is mixed with the fuel jet in the additional air flow passage, the flow resistance to the flow of the fuel jet is increased. Therefore, when the flow rate of the additional air is increased, the transporting gas flows by avoiding the additional air flow passage.

However, the fuel particles have a stronger tendency to flow straight due to the inertia force compared to gas, the fuel particles flow at the additional air flow passage side. In the additional air flow passage side of the separator, the decrease in the fuel particles is smaller compared to the decrease in the flow rate of the transporting gas.

As the result, the transporting gas is replaced by the additional air jet, and accordingly the oxygen concentration around the fuel particles becomes higher then the oxygen concentration of the transporting gas. After ejected from the fuel nozzle, the combustion reaction is progressed by the high oxygen concentration to stably form a flame at the exit of the fuel nozzle.

In order to prevent back fire or burnout by forming flame inside the fuel nozzle, it is preferable that the fuel retention time in the fuel nozzle is shorter than the ignition lag time of the fuel (approximately 0.1 second). Since the fuel transporting gas generally flows inside the fuel nozzle at a flow speed of 12 to 20 m/s, the distance from the exit of the fuel nozzle to the exit of the additional air nozzle is shorter than 1 m.

It is preferable to arrange a flow passage contracting member in the fuel nozzle of the solid fuel burner in accordance with the present invention. By the flow passage contracting member, the flow passage cross-sectional area of the fuel nozzle is from the upstream side of the burner once contracted and successively expanded to the original size. Since the flow speed of the fuel transporting gas flowing inside the fuel nozzle is increased by contracting the flow passage cross-sectional area, it is possible to prevent back fire from propagating up to a portion upstream of the flow passage contracting member even if flame is formed inside the fuel nozzle due to occurrence of instantaneous reduction in the flow speed.

Therein, it is preferable that in order to decrease the flow resistance of the fuel transporting gas, the flow passage contracting member has a shape of smoothly varying the flow passage cross-sectional area such as a venturi.

Further, by providing the inside of the fuel nozzle with the concentrator composed of the portion contracting and the portion expanding the flow passage cross-sectional area inside the fuel nozzle arranged in this order from the upstream side of the burner, a velocity component flowing toward the outer peripheral direction along the concentrator is induced in the fuel particles. Since the inertia force of the fuel particle is larger than that of the transporting gas, the fuel particles unevenly flow along near the inner wall surface of the fuel nozzle to reach the exit of the nozzle. As the result, a fuel-condensed jet is formed on the inner wall surface of the fuel nozzle.

Therein, in the case where the exit of the additional air nozzle is in the position where the exit overlaps with the separator when the exit is seen from the direction vertical to the axis of the burner, by ejecting air from the additional air nozzle toward the direction nearly perpendicular to the flow direction of the fuel jet to increase the oxygen concentration along the inner wall surface of the fuel nozzle, a high fuel concentration and high oxygen concentration region is formed along the inner wall surface of the fuel nozzle. As the result, after ejected from the fuel nozzle, combustion reaction is progressed by the high oxygen concentration to stably form a flame at the exit of the fuel nozzle.

The fuel particles flowing along the inner periphery of the outer side separation wall of the fuel nozzle are mixed with the air ejected from the air nozzle in the outer side of the fuel nozzle at a position near the exit of the fuel nozzle. Further, the pulverized coal is apt to be ignited in contact with a high temperature gas of a circulation flow formed in the downstream side of a flame stabilizing ring to be described later.

As described above, there is a method that the oxygen concentration of the mixed fluid of the fuel and the transporting gas flowing in the outer side flow passage between the flow passages divided by the separator provided in the fuel nozzle is increased by arranging additional air nozzles on the inner periphery of the outer side separation wall of the fuel nozzle and ejecting the additional air toward the center axis of the burner.

On the other hand, the same effect can be obtained by a method that the oxygen concentration of the mixed fluid of the fuel and the transporting gas flowing in the inner side flow passage between the flow passages divided by the separator provided in the fuel nozzle is increased by arranging additional air nozzles on the outer periphery of the inner side separation wall of the fuel nozzle and ejecting the additional air outward from the center axis of the burner.

It is preferable that the obstacle (flame stabilizing ring) for interfering with flow of the solid fuel mixture and the air ejected from the fuel nozzles is arranged in the front end portion of the separation wall between the fuel nozzle and the outer-side air nozzle. Pressure is decreased in the downstream side of the flame stabilizing ring to form circulation flow flowing from the downstream side to the upstream side. Inside the circulation flow, the air, the fuel and the fuel transporting gas ejected from a group of nozzles in the outer side, and the high temperature gas from the downstream side are stagnated. As the result, temperature inside the circulation flow becomes high to act as an ignition source of the fuel jet. Therefore, the flame is stably formed from the exit portion of the fuel nozzle.

When the toothed flame stabilizing ring is arranged in the exit of the fuel nozzle in a direction of blocking the fuel jet, disturbance of the fuel jet is increased by the flame stabilizing ring to mix the fuel jet with air, the combustion reaction is progressed, and the ignition of the fuel is accelerated.

The solid fuel burner in accordance with the present invention is capable of varying an amount of air ejected from the additional air nozzle corresponding to a combustion load.

When a combustion load is low, the amount of air ejected from the additional air nozzle is increased. In this case, since the oxygen concentration inside the fuel nozzle is increased by the air ejected from the additional air nozzle, the combustion reaction of the fuel is accelerated more than in the case of low oxygen concentration, and accordingly ignition of the fuel is advanced to form flame at a position near the fuel nozzle.

When the combustion load is high, the amount of air supplied from the additional air nozzle is decreased. In this case, since the oxygen concentration inside the fuel nozzle is low, the combustion reaction of the fuel is not accelerated, and accordingly flame is formed at a position inside the combustion apparatus distant from the fuel nozzle.

When the temperature of the solid fuel burner or the wall of the combustion apparatus outside the solid fuel burner is excessively high, combustion ash attaches onto the structures of the solid fuel burner and the wall of the furnace to cause a phenomenon called as slugging in which the attached substance is growing.

In the present invention, as the flame separates from the solid fuel burner, the temperature of the solid fuel burner or the wall of the combustion apparatus outside the solid fuel burner decreases, whereby occurrence of the slugging can be suppressed.

By changing the amount of air ejected from the additional air nozzle based on signals from the thermometer or the radiation pyrometer or the flame detector arranged in the solid fuel burner or on a wall of the furnace around the solid fuel burner, the position of forming the flames of the solid fuel burners can be controlled.

The description on the above has been made on the case where the melting point of the combustion ash of the solid fuel is low, and accordingly the slugging is apt to occur. In the case where the melting point of the combustion ash of the solid fuel is low or the thermal load of the furnace is low, and accordingly slugging is not a problem, the flame of the solid fuel burner may be formed from the exit of the fuel nozzle.

On the other hand, when the combustion load is low, the amount of air is preferably controlled so that a ratio of the total amount of air supplied from the additional air nozzle and supplied from the additional air nozzle to the amount of air necessary for completely burning the volatile matters, that is, a ratio of the air to the volatile matters may becomes 0.85 to 0.95.

When the combustion load is low, it is difficult to keep stable combustion. Therefore, by setting the ratio of air to the volatile to 0.85 to 0.95, it is easy to keep stable combustion. The amount of radiant heat to the solid-fuel nozzle and the wall of the combustion apparatus can be controlled by varying the amount of air to change the position of forming flame inside the combustion apparatus.

Under the high load condition, it is preferable that the flame is formed at a position distant from the solid fuel burner because the thermal load in the combustion apparatus is high.

According to the combustion method using the solid fuel burner in accordance with the present invention, under the high load condition of the combustion apparatus, the fuel is ignited at a position distant from the solid fuel burner, and the flame is formed in the central portion of the combustion apparatus. In order to monitor the flame formed under the high load condition, it is preferable to monitor the flame in the central portion of the combustion apparatus where the flames of the solid fuel burners gather.

Under the low load condition, since the thermal load inside the combustion apparatus is low, the temperature of the solid fuel burner and the wall of the combustion apparatus around the solid fuel burner is lower than the temperature under the high load condition, and accordingly the slugging hardly occurs even if the flame is brought close to the solid fuel burner.

Under the low load condition of the combustion apparatus, the fuel is ignited near the solid fuel burner to form flame. At that time, the flames are formed burner-by-burner by the individual solid fuel burners, and the frames are sometimes separately formed inside the combustion apparatus. Further, the temperature in the furnace is lower compared to that under the high load condition, the time of complete burning of the fuel becomes long. Therefore, if the flame departs from the solid fuel burner, the fuel can not completely burned before reaching the exit of the furnace, which causes decrease of the combustion efficiency and increase of an amount of unburned fuel. Therefore, it is preferable that each of the flames formed at the exits of the individual solid fuel burners is monitored.

In the solid fuel burner in accordance with the present invention, the outer side air can be ejected expanding from the center axis of the burner by providing the air nozzle (the outer side air nozzle) outside the fuel nozzle and providing the guide for determining the ejecting direction of the outer side air at the exit of the outer side air nozzle. In the case of such a structure, the speed of the fuel is decreased near the burner because the fuel is expanded along the outer side air, and accordingly the retention time near the solid fuel burner is increased. As the result, the combustion efficiency in the furnace can be improved and the amount of unburned fuel can be decreased by increases of the retention time of the fuel in the furnace.

By adjusting the guide for guiding the jet from the outermost side air nozzle arranged in the outermost side to set an angle so that the outer side air jet may flow along the individual solid fuel burners and the wall of the combustion apparatus existing outside the solid fuel burners, the outer side air can cool the individual solid fuel burners and the wall of the combustion apparatus existing outside the solid fuel burners to suppress occurrence of the slugging.

As the combustion apparatus having the plurality of solid fuel burners in accordance with the present invention on the wall surface of the combustion apparatus, there are a coal-fired boiler, a peat-fired boiler, a biomass-fired boiler (a wood-fired boiler) and so on.

By arranging the thermometers or the radiation pyrometers in the solid fuel burners in accordance with the present invention or on the wall surface of the furnace existing outside the solid fuel burners, the combustion apparatus is operated so as to varying the amount of air ejected from the additional air nozzle of the solid fuel burner. By doing so, the flames are controlled so as to be individually formed at appropriate positions in the combustion apparatus corresponding to the combustion load change.

The index of whether or not the flames are formed in the appropriate positions is determined, for example, as follows. That is, the furnace is operated so that the front end of the solid fuel flame inside the furnace may be formed at a position near the wall surface of the furnace outside the exit of the fuel nozzle when the furnace is operated under the low load condition, and so that the flame may be formed at a position in the furnace 0.5 m or more distant from the exist of the fuel nozzle when the furnace is operated under the high load condition.

The combustion apparatus is appropriately operated by monitoring using a flame detector or visually the flames in the central portion or the vicinity in the combustion apparatus where the flames of the solid fuel burners in accordance with the present invention gather when the combustion apparatus is operated under the high load condition, and by monitoring the individual flames formed in the exits of the solid fuel burners in accordance with the present invention when the combustion apparatus is operated under the low load condition.

DESCRIPTION OF EMBODIMENTS OF THE INVENTION

Embodiments of the solid fuel burner, the combustion method using the solid fuel burner, the combustion apparatus having the solid fuel burners and the operating method of the combustion apparatus in accordance with the present invention will be described below, referring to the accompanying drawings.

Embodiment 1

Figure 1:
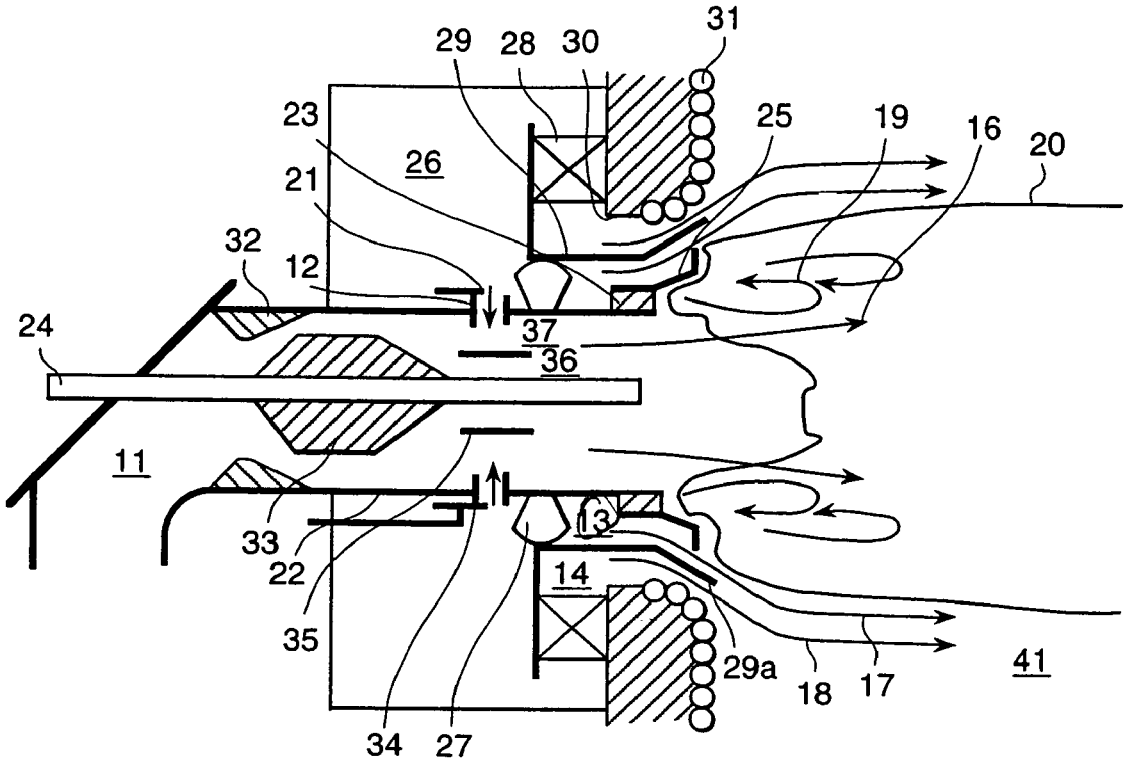
FIG. 1 is a cross-sectional view showing the structure of an embodiment 1 of a solid fuel burner in accordance with the present invention, and the view shows a state in which the flame of the solid fuel burner is formed near a circulation flow in the downstream side of a flame stabilizing ring when the embodiment 1 of the solid fuel burner is used under a low load condition.
Figure 2:
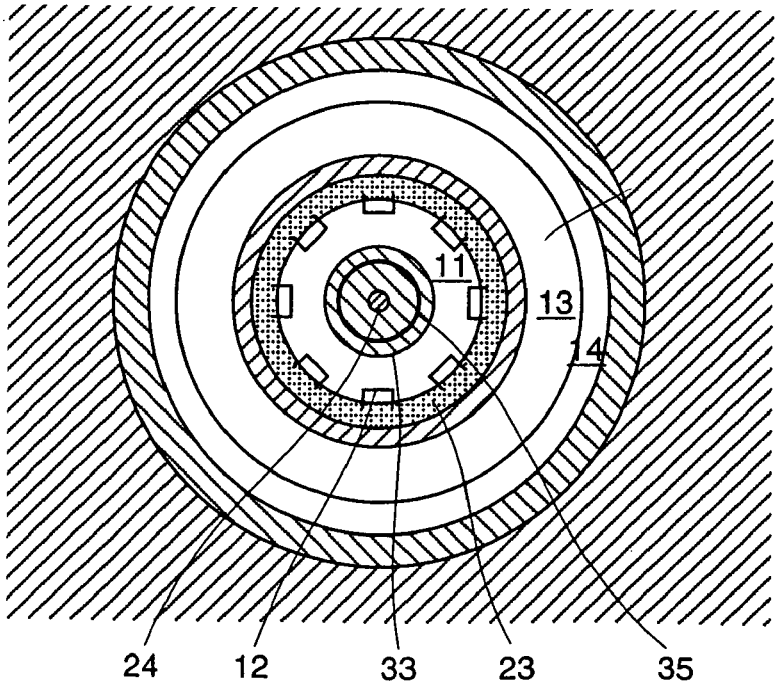
FIG. 2 is a schematic view showing the structure of the embodiment 1 of the solid fuel burner, viewed from the inner side of a furnace.

FIG. 1 is a cross-sectional view showing the structure of an embodiment 1 of the solid fuel burner in accordance with the present invention, and the view shows a state in which the flame 20 of the solid fuel burner is formed near a circulation flow 19 in the downstream side of a flame stabilizing ring 23 when the embodiment 1 of the solid fuel burner is used under a low load condition. FIG. 2 is a schematic view showing the structure of the embodiment 1 of the solid fuel burner, viewed from the inner side of the furnace 41.

The solid fuel burner of the present embodiment 1 comprises a combustion improving oil gun 24 in the central portion; and a fuel nozzle 11 for ejecting the mixed fluid of the fuel and the transporting gas of the fuel around the combustion improving gun 24. A plurality of additional air nozzles 12 are arranged so that the nozzle exits are directed from an outer side separation wall 22 of the fuel nozzle 11 toward the center axis of the solid fuel burner.

The combustion improving gun 24 arranged so as to penetrate the central portion of the fuel nozzle is used for igniting the fuel at starting the solid fuel burner.

In the fuel nozzle 11, there are arranged a flow passage contracting member (a venturi) 32, an obstacle (a concentrator) 33 and a separator 35 in this order from the upstream side. The additional air nozzles 12 are set in a direction that the air ejected toward the outer side separation wall 22 of the fuel nozzle 11 becomes nearly perpendicular to the flow of the mixed fluid flowing in the fuel nozzle 11. Therefore, the exit of the additional air nozzle 12 is in a position where the exit overlaps with the separator 35 when the exit is seen from a direction vertical to an axis of the burner.

Outside of the fuel nozzle 11, there are the annular outer side air nozzles (a secondary air nozzle 13, a tertiary air nozzle 14) for ejecting air, and the annular outer side air nozzles are concentric to the fuel nozzle 11.

An obstacle called as a flame stabilizing ring 23 is arranged in the front end portion of the fuel nozzle, that is, in the exit side to the furnace. The flame stabilizing ring 23 serves as an obstacle to the fuel jet 16 composed of the fuel and the transporting gas ejected from the fuel nozzle 11 and the secondary air flow 17 flowing through the secondary air nozzle 13. Therefore, the pressure in the downstream side of the flame stabilizing ring 23, that is, in the combustion apparatus 41 side is decreased, and flow toward the direction opposite to the direction of the fuel jet 16 and the secondary air flow is induced. The opposite direction flow is defined as a circulation flow 19.

High temperature gas produced by combustion of fuel flows into the inside of the circulation flow 19 from the downstream side, and is stagnated in the circulation flow 19. As the high temperature gas and the fuel in the fuel jet 16 are mixed at the exit of the solid fuel burner, the temperature of the fuel particles are increased by the radiant heat from the inside of the furnace 41 to be ignited.

The secondary air nozzle 13 and the tertiary air nozzle 14 are separated from each other by a separating wall 29, and the front end portion of the separating wall 29 is formed in a guide **29*a* for ejecting the flow of the tertiary air 18 so as to have an angle to the fuel jet 16. If a guide 25, 29*a* for guiding the ejecting direction of the air toward the direction departing from the center axis of the burner is arranged at the exit of the flow passages of the outer air nozzles (the secondary air nozzle 13 and the tertiary air nozzle 14), the guide is useful for easily forming the circulation flow 19, together with the flame stabilizing ring 23**.

In order to add swirling force to the air ejected from the secondary air nozzle 13 and the tertiary air nozzle 14, swirlers 27 and 28 are arranged in the secondary air nozzle 13 and the tertiary air 14.

A burner throat 30 composing the wall of the furnace also serves as an outer peripheral wall of the tertiary air nozzle. Water pipes 31 are arranged in the wall of the furnace.

In the present embodiment 1, the oxygen concentration in the fuel jet 16 flowing through the fuel nozzle 11 is lowered using the combustion exhaust gas for the transporting gas of the fuel. As an example to which such a combustion method is applied, there is combustion of coal such as blown coal or lignite which is typical of a low coalification rank, peat or wood.

These kinds of fuels are low in calorific value compared to coal of a high coalification rank such as bituminous coal and anthracite, and are generally low in grindability or pulverizability. Furthermore, combustion ash of these solid fuels is low in melting temperature. Since these solid fuels contain much volatile matters, these solid fuels easily self-ignite in a storage process and a pulverizing process under air atmosphere, and accordingly are difficult to be handled compared to bituminous coal. In a case where blown coal or lignite is pulverized to be burned, a mixed gas of combustion exhaust gas and air is used as a transporting gas of the fuel in order to prevent these fuels from self-igniting. The combustion exhaust gas reduces the oxygen concentration and suppressing oxidizing reaction (burning) to prevent the fuel from self-burning. On the other hand, the retention heat of the combustion exhaust gas can be used for drying the fuel by evaporating the moisture in the fuel.

When the fuel is ejected from a solid fuel burner, the oxidation reaction of the fuel transported by the transporting gas of a low oxygen concentration is limited by the oxygen concentration around the fuel. Therefore, the combustion speed is slow compared to that in a case of fuel transported by air. Since the oxidation reaction of fuel is generally activated after the fuel is mixed with air ejected from the air nozzle, the combustion speed is determined by the mixing speed with the air. Therefore, when fuel such as blown coal or lignite is burned under the low load condition of the solid fuel burner in which the combustion amount of fuel is small, blow-off or flameout of the flame 20 occur more often compared to the case of combustion of bituminous coal. Further, complete burning time of the fuel is longer compared to complete burning time in a case of transporting the fuel using air, and accordingly an amount of unburned components or carbons at the exit of the furnace 41 is increased. Further, the flame temperature is low because the combustion speed is slow. As the result, the reduction reaction of nitrogen oxides NOx to nitrogen under the reduction atmosphere of high temperature above 1000 C.° is difficult to be used, and accordingly the concentration of NOx at the exit of the furnace becomes higher compared to the case of transporting the fuel using air.

The present embodiment 1 has the additional air nozzles 12 for ejecting air toward the direction nearly perpendicular to the flow direction of the fuel jet inside the fuel nozzle. When the additional air jet 21 to be ejected from the additional air nozzle 12 is ejected toward the direction nearly perpendicular to the flow direction of the fuel jet, the mixing between the fuel jet and the additional air is progressed because the speed difference between the fuel particles and the additional air jet is larger than the speed difference in the case where the additional air jet to be ejected from the additional air nozzle is ejected in parallel to the direction of the fuel jet. Particularly, since the specific density of the fuel particles is larger than that of air, the fuel particles are mixed into the additional air jet by an inertia force.

Further, in the present embodiment 1, the exit of the additional air nozzle 12 is in a position where the exit overlaps with the separator 35 when the exit is seen from a direction vertical to an axis of the burner. Therefore, the ejecting direction is blocked by the separator 35, and accordingly the additional air jet 21 is not expanded to the inner side flow passage 36 of the separator 35 to flow through the outer side flow passage 37.

The flow resistance of the outer side flow passage 37 of the separator 35 is large compared to the flow resistance of the inner side flow passage 36 because the additional air jet 21 is mixed. When the amount of the additional air is increased, the amount of the transporting gas flowing through the outer side flow passage 37 of the separator 35 is decreased. On the other hand, since the fuel particles flow into the outer side flow passage 37 irrespective of the flow resistance because of the inertia force larger than that of the gas, the amount of the fuel particles flowing through the outer side flow passage 37 of the separator 35 is almost unchanged.

Therefore, when the amount of the additional air is increased, the amount of the transporting gas entering into the outer side flow passage 37 together with the fuel particles is decreased. Since the transporting gas is replaced by the additional air, dilution of the oxygen concentration is smaller compared to simply mixing between the transporting gas and the additional air, and accordingly the oxygen concentration becomes high. Further, the separator 35 can prevent the fuel particles from being dispersed by disturbance produced at mixing of the additional air and the transporting gas. Therefore, in the outer side flow passage 37 of the separator 35, the oxygen concentration is high and the fuel density is also high.

According to the present embodiment 1, the combustion reaction is easily progressed after ejected from the fuel nozzle 11 by the high oxygen concentration and the high fuel density, and the flame 20 can be stably formed at the exit of the fuel nozzle.

In order to prevent back fire or burnout by forming flame 20 inside the fuel nozzle 11, it is preferable that the distance from the exit of the additional air nozzle 12 to the exit of the fuel nozzle is determined so that the retention time after mixing of the fuel jet with the additional air flow 21 may be shorter than the ignition time lag of the fuel. In general, the index is the ignition time lag of a gas fuel (approximately 0.1 second) which is shorter than the ignition time lag of pulverized coal. Since the fuel transporting gas generally flows inside the fuel nozzle at a flow speed of 12 to 20 m/s, the distance from the exit of the additional air nozzle 12 to the exit of the fuel nozzle 11 is shorter than 1 m.

Further, in the present embodiment 1, a flow passage contracting member (venturi) 32 for contracting the flow passage provided inside the fuel nozzle 11 is arranged in the outer side wall 22 upstream of the fuel nozzle 11. An obstacle (a concentrator) 33 for once contracting and then expanding the flow passage is arranged outside of the oil gun 24 in the fuel nozzle central portion inside the fuel nozzle 11. The obstacle 33 is arranged in the downstream side of the flow passage contracting member 32 in the solid fuel burner (the furnace 41 side).

The venturi 32 induces the velocity component in the direction toward the center axis of the fuel nozzle in the transporting gas and the fuel particles. By arranging the concentrator 33 in the downstream side of the venturi 32, a velocity component toward the outer side separation wall 22 of the fuel nozzle is induced in the fuel transporting gas and the fuel particles. Since the inertia force of the fuel particles is larger than that of the fuel transporting gas, the fuel particles can not follow the flow of the fuel transporting gas. Therefore, the fuel particles form a high density zone near the wall surface opposite to the flow passage change direction. By inducing the velocity component toward the outer side separation wall 22 of the fuel nozzle by the venturi 32 and the concentrator 33, the fuel in the outer side flow passage 37 of the separator 34 flow along the outer side separation wall 22 of the fuel nozzle 11.

Since the air ejected from the additional air nozzle is ejected to the outer side flow passage 37 of the separator 35, the zone having the high fuel density and the high oxygen concentration is unevenly formed toward the inner side wall surface of the outer side separation wall 22 of the fuel nozzle 11. As the result, the combustion reaction of the fuel particles ejected from the fuel nozzle 11 is easily progressed by the high fuel density and the high oxygen concentration, and accordingly the flame 20 is stably formed at the exit of the fuel nozzle.

At that time, the fuel jet flowing in the inner wall surface side of the outer side separation wall 22 of the fuel nozzle 11 is easily mixed with the air ejected from the outer side air nozzle at a position near the exit of the fuel nozzle 11. Further, when the fuel jet is mixed with the high temperature gas of the circulation flow produced in the rear stream side of the flame stabilizing ring 23, temperature rise of the fuel particles is caused, and the fuel is apt to be ignited.

The air is ejected from the additional air nozzle 12 in the direction nearly perpendicular to the direction of the fuel jet flowing inside the fuel nozzle 11, the separator 35 is arranged in the fuel nozzle 11, and an exit of the additional air nozzle is in a position where the exit overlaps with the separator when the exit is seen from a direction vertical to an axis of the burner, as described above. By doing so, the oxygen concentration at a position near the outer side separation wall 22 of the fuel nozzle 11 becomes high. The mixing between the fuel particles and the air is progressed, and the flame 20 is stably formed at the exit of the fuel nozzle 11. Therefore, combustion can be stably continued in a load lower than a conventional low load.

In FIG. 1, the diameter of the upstream side end of the separator 35 is smaller than the diameter of the obstacle 33 on the fuel nozzle 11. That is, the cross-sectional area of the flow passage of the outer side flow passage 37 in the upstream side end portion of the separator 35 among the fuel nozzle flow passage divided by the separator 35 is larger than the cross-sectional area of the flow passage contracted by the obstacle 33. By such a structure of the fuel nozzle described above, the upstream side end portion of the separator is hidden by the obstacle 33 when the fuel ejecting exit is seen from the upstream side of the fuel nozzle 11. Therefore, the fuel particles are easy to enter the outer side flow passage 37 of the separator 35 due to the inertia force.

The fuel density in the outer side flow passage of the fuel nozzle 11 becomes high because an amount of the fuel particles colliding against the upstream side end portion of the separator 35 thereby to disturb the flow is decreased.

In the case where blown coal or lignite is burned under a high thermal load, the amount of fuel burning at a position near the solid fuel burner is increased under a good mixing condition of air and the fuel because the fuel contains a large amount of volatile matters. Accordingly, the thermal load near the solid fuel burner is locally increased. At that time, temperature rise of the structure of the solid fuel burner and the wall of the furnace is increased by radiant heat from the flame 20.

In a case of low melting temperature of the combustion ash, there is possibility to cause slugging by that combustion ash attaches and melts on the wall of the furnace etc. When the combustion ash attached on the wall of the furnace etc grows, there is possibility to cause blocking of the flow passage of the solid fuel burner or occurrence of instability in the heat absorption balance of the furnace wall. In the worst case, operation of the combustion apparatus may be stopped. Particularly, blown coal and lignite are apt to cause slugging because the melting temperature of the combustion ash of blown coal and lignite is low compared to that of bituminous coal.

In the present embodiment 1, the trouble of slugging easily caused under the high load condition is solved by changing the position of forming the flame 20 according as the load of the solid fuel burner changes. That is, the flame 20 is formed at a position distant from the solid fuel burner when the load condition is high, and the flame 20 is formed from a position near the exit of the fuel nozzle 11 when the load condition is low. Under the low load condition, even if the flame 20 is brought close to the wall of the furnace or the solid fuel burner, the temperature of the solid fuel burner and the wall of the furnace around the solid fuel burner is lower than that in the case of the high load condition because of the low thermal load in the furnace 41. Therefore, the slugging does not occur.

In the present embodiment 1, when the load condition is low, the flame 20 is formed from a position near the exit of the fuel nozzle 11, and the high temperature gas is stagnated in the circulation flow 19 which is formed in the downstream side of the flame stabilizing ring 23 and the guide 25. Further, the oxygen concentration in the fuel jet 16 near the flame stabilizing ring 23 is increased by opening a flow control valve 34 of the additional air nozzle 12 to supply air. As the result, since the combustion speed becomes higher compared to the condition of low oxygen concentration, ignition of the fuel particles can be advanced to form the flame 20 near the fuel nozzle 11.

Under the high load condition, the flame 20 is formed at a position distant from the solid fuel burner to reduce the thermal load near the solid fuel burner. In the present embodiment 1, the amount of supplied air is reduced compared to the case of the low load condition by closing the flow control valve 34 of the additional air nozzle 12. At the time, the oxygen concentration in the fuel jet 16 at the position near the flame stabilizing ring 23 becomes lower than that in the low load condition to make the combustion speed slower. As the result, the temperature of the circulation flow produced in the downstream side of the flame stabilizing ring 23 is lowered to decrease the amount of radiant heat received by the structure of the solid fuel burner, and accordingly occurrence of slugging can be suppressed.

Figure 3:
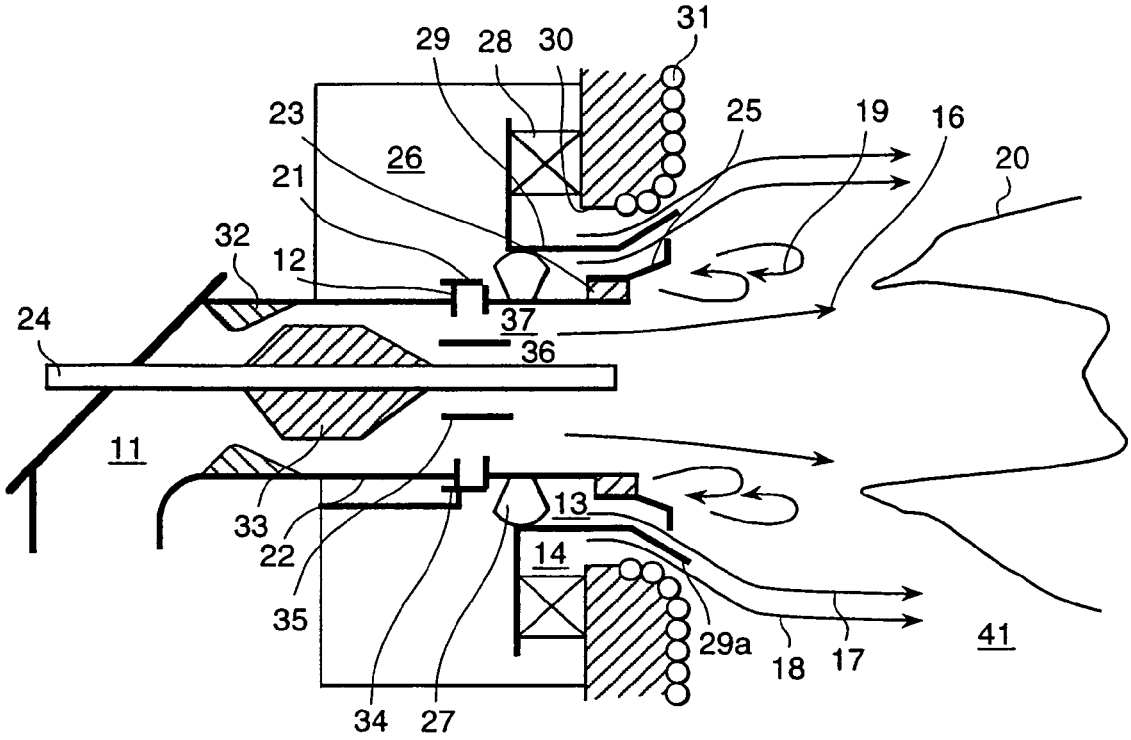
FIG. 3 is a view showing a state in which flame of the solid fuel burner is formed near the circulation flow in the downstream side of the flame stabilizing ring when the embodiment 1 of the solid fuel burner is used under a high load condition.

FIG. 3 is a view showing a state in which flame 20 of the solid fuel burner is formed separated from the circulation flow 19 in the downstream side of the flame stabilizing ring 23 when the embodiment 1 of the solid fuel burner is used under the high load condition.

Figure 4:
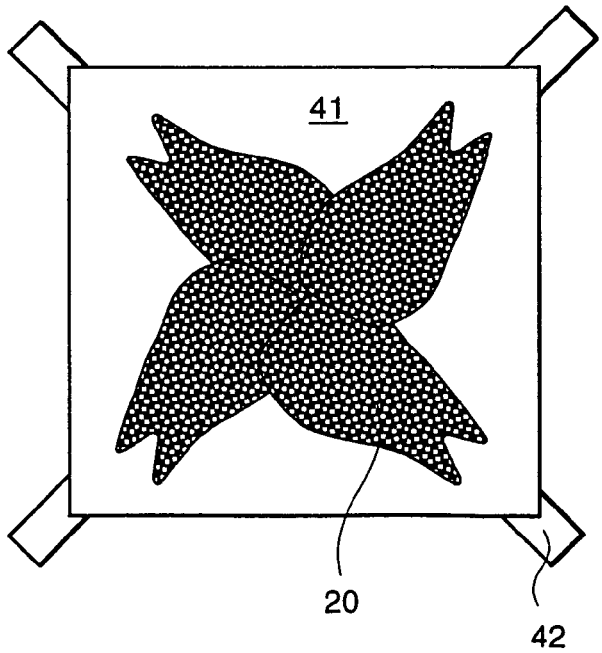
FIG. 4 is a horizontal cross-sectional view showing the structure of a combustion apparatus using the embodiment 1 of the solid fuel burners.

FIG. 4 is a horizontal cross-sectional view showing the structure of a combustion apparatus using the embodiment 1 of the solid fuel burners 42. When the solid fuel burners 42 are used under the high load condition as shown in FIG. 3, it is preferable that the flames 20 are mixed with one another inside the furnace 41 in order to reduce probability of occurrence of flameout.

Although FIG. 4 shows a structure in which the solid fuel burners 42 are arranged in the four corners of the wall of the furnace, the same can be said in a case of an opposed combustion type in which the solid fuel burners 42 are arranged on the opposed walls of the combustion apparatus.

In the present embodiment 1, description has been made on the remedy for occurrence of slugging when the melting point of combustion ash of the solid fuel is low. When the melting point of combustion ash of the solid fuel is high or when the problem of slugging does not occur due to a low load condition of the furnace, the flame of the solid fuel burner may be formed at the exit of the fuel nozzle, as shown in FIG. 1.

In order to reduce nitrogen oxides NOx produced by combustion, it is preferable that the amount of air is controlled so that a ratio of the total amount of air supplied from the additional air nozzle and supplied from the additional air nozzle to the amount of air necessary for completely burning the volatile matters may becomes 0.85 to 0.95.

Most of fuel is burned by mixed with air supplied from the above-described nozzles contained in the fuel nozzle 11 (the first step), and then burned by being mixed with the secondary air flow 17 and the tertiary air flow 18 (the second step). Further, in a case where an after air port 49 (refer to FIG. 9) for supplying air into the combustion apparatus 41 is arranged in the downstream side of the solid fuel burner, the fuel is completely burned by being mixed with air supplied from the after air port 49 (the third step). The volatile matters in the fuel are burned in the first step described above because the combustion speed of the volatile matters is faster than that of the solid fuel.

At that time, when the air ratio to the volatile matters is set to 0.85 to 0.95, combustion of the fuel can be accelerated to be burned by high flame temperature though the condition is lacking in oxygen. Since the fuel is reduction-burned under lacking of oxygen in the combustion in the first step, the nitrogen oxides (NOx) produced from nitrogen in the fuel and nitrogen in air are converted to harmless nitrogen, and accordingly, the amount of NOx exhausted from the furnace 41 can be reduced. Since the fuel reacts under high temperature, the reaction of the second step is accelerated to reduce the amount of unburned components.

As shown in FIG. 2 of the solid fuel burner seeing from the side of the furnace 41, the solid fuel burner of the present embodiment is cylindrical in which the cylindrical fuel nozzle 11, the cylindrical secondary nozzle 13 and the cylindrical tertiary nozzle are concentrically arranged.

Figure 5:
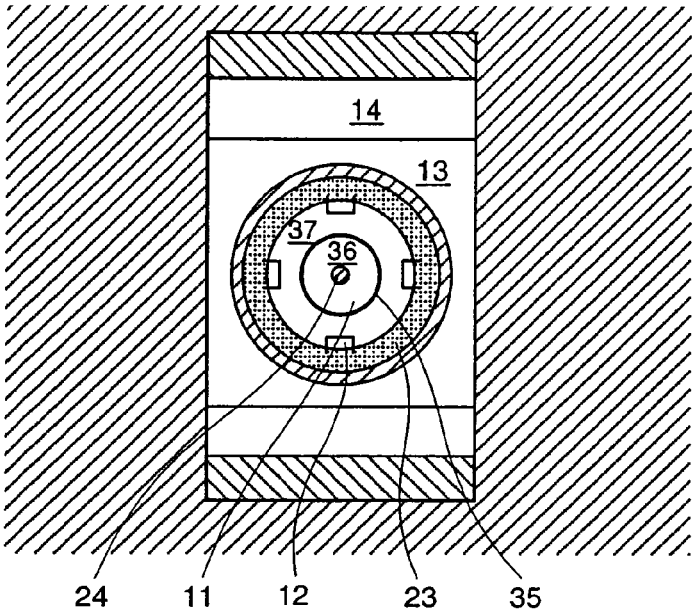
FIG. 5 is a view showing another example of the solid fuel burner shown in FIG. 1.

FIG. 5 is a view showing another example of a nozzle part of the solid fuel burner. The fuel nozzle 11 may be rectangular, the concentrator 33 may be triangular, or the air nozzle structure that the fuel nozzle is put between at least part of the outer side air nozzles such as the secondary air nozzle 13, the tertiary air nozzle 14 etc may be acceptable. Further, the outer side air may be supplied from a single nozzle, or the nozzle structure divided into three or more parts may be acceptable.

Figure 6:
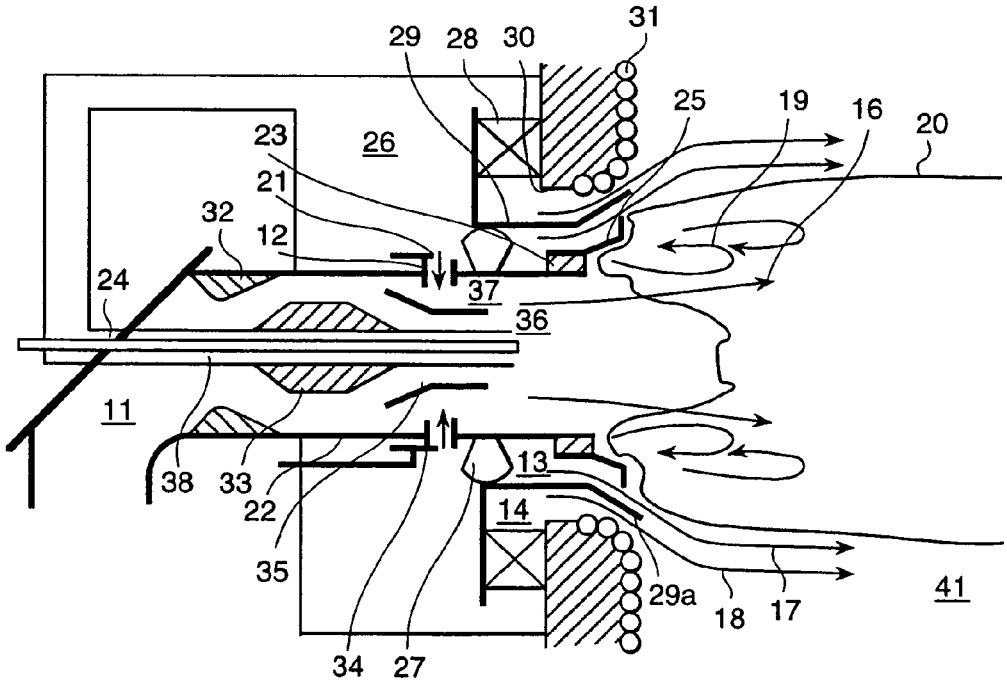
FIG. 6 is a cross-sectional view showing a further other example of a solid fuel burner in accordance with the present invention.

FIG. 6 is a cross-sectional view showing a further other example of a solid fuel burner in accordance with the present invention. In this example, an inner side air nozzle 38 is arranged in the solid fuel burner 11, and is connected to a wind box 26 using a pipe. Part of the air supplied to the solid fuel burner is ejected from the inner side air nozzle 38.

When the air is mixed from the fuel nozzle, mixing of the fuel and the air is accelerated compared to the mixing using only the outer side air nozzles 13 and 14. Further, when a large amount of air is ejected from the inner side air nozzle 38, the flow speed of the fuel jet 16 flowing in the side portion is accelerated, and as the result, the ignition position of the fuel can be made distant from the solid fuel burner. Therefore, by decreasing the amount of air ejected from the additional air nozzle 12 and increasing the amount of air ejected from the inner side air nozzle 38, it is possible to cope with the case that the flame is formed at a position distant from the solid fuel burner under the high load condition.

Further, the separator 35 of the solid fuel burner shown in FIG. 6 is tapered in the upstream side. By forming the separator in the tapered shape, the ratio of amounts of the fuel jet 16 flowing through the inner side flow passage 36 and the fuel jet flowing through the outer side flow passage 37 divided by the separator 35.

In the case of the solid fuel burner shown in FIG. 6, the flow speed is decreased in the outer side flow passage 37 of the separator 35 because the cross-sectional area of the flow passage is widened by the tapered shape, and accordingly the additional air 21 ejected from the additional air nozzle 12 is easy to reach the separator 35. Further, since the flow speed of the flow 16 of the fuel and the transporting gas is decreased in the outer periphery of the exit of the fuel nozzle 11, the fuel particle become easily ignited in a position near the solid fuel burner. Therefore, the flame 20 can be easily formed from a portion close to the solid fuel burner.

Figure 7:
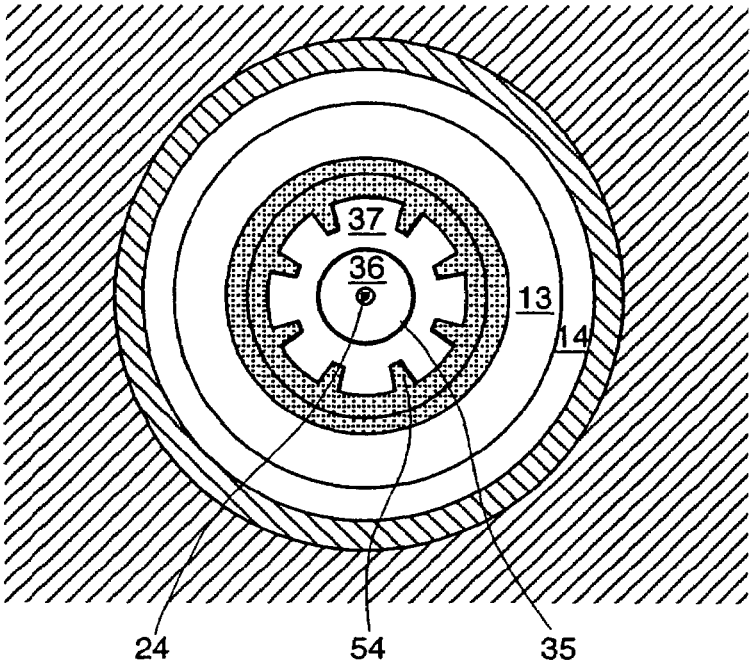
FIG. 7 is a schematic view showing the structure of the solid fuel burner employing a flame stabilizing ring having another structure seeing from the inner side of a furnace.

FIG. 7 is a schematic view showing the structure of the solid fuel burner employing a flame stabilizing ring having another structure seeing from the inner side of a furnace. In the present embodiment, a toothed flame stabilizing ring 54 having projected plate-shaped edges may be arranged in the exit of the fuel nozzle 11, as shown in FIG. 7. The fuel flows around to the back of the toothed flame stabilizing ring 54 to be easily ignited. That is, the fuel is ignited in the back side of the toothed flame stabilizing ring 54.

Embodiment 2

Figure 8:
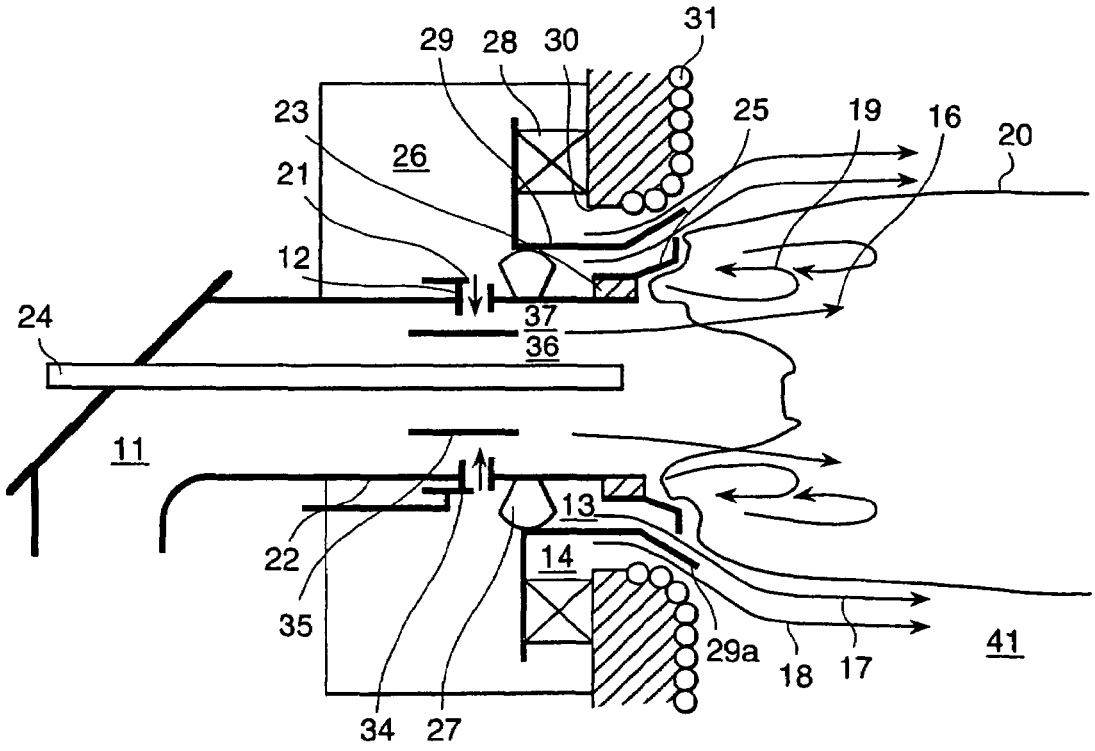
FIG. 8 is a cross-sectional view showing the structure of an embodiment 2 of a solid fuel burner without any concentrator in accordance with the present invention, and the view shows a state in which fuel ejected from the solid fuel burner under a low load condition is burning.

FIG. 8 is a cross-sectional view showing the structure of an embodiment 2 of a solid fuel burner without any concentrator in accordance with the present invention, and the view shows a state in which fuel ejected from the solid fuel burner under a low load condition is burning. In the embodiment 1, the concentrator 33 is arranged in the fuel nozzle 11. However, even without the concentrator 33 as the present embodiment 2, when air is ejected from the additional air nozzle in the direction nearly perpendicular to the direction of the fuel jet flowing inside the fuel nozzle 11, the speed difference between the fuel particles and the air becomes larger than in the case of ejecting the additional air in parallel to the direction of the fuel jet, and the fuel jet and the air are mixed with each other similarly to the case of the embodiment 1.

Further, the additional air nozzle 12 and the separator 35 are arranged at the position overlapping in a direction perpendicular to the ejecting direction of the mixed fluid ejected from the fuel nozzle 11. Therefore, the additional air jet 21 is blocked to flow toward the ejected direction by the separator 35, and accordingly does not expand into the inner side flow passage 36 of the separator 34 but flows through the outer side flow passage 37.

The flow resistance of the outer side flow passage 37 of the separator 35 is larger than that of the inner side flow passage 36 because the additional air jet 21 is mixed with the mixed fluid. When the amount of the additional air is increased, the amount of the transporting gas flowing the outer side flow passage 37 is decreased. On the other hand, the fuel particles flow into the outer side flow passage 37 regardless of the flow resistance because the inertia force of the fuel particles is larger than that of gas. Therefore, the amount of the fuel particles is almost unchanged.

Therefore, when the amount of the additional air is increased, the amount of the transporting gas entering into the outer side flow passage 37 together with the fuel particles in decreased, and the transporting gas is replaced by the additional air. Compared to the case where the additional air flows in parallel to the flow direction of the transporting gas, dilution of the oxygen concentration is smaller, and accordingly the oxygen concentration becomes higher. Further, the separator 35 can prevent the fuel particles from being dispersed by disturbance produced at mixing of the additional air and the transporting gas. As the result, the oxygen concentration is high in the outer side flow passage 37 of the separator 35, and the fuel density to the transporting gas is also higher in the outer side flow passage 37 because most of the transporting gas flows through the inner side flow passage 36.

Embodiment 3

Figure 9:
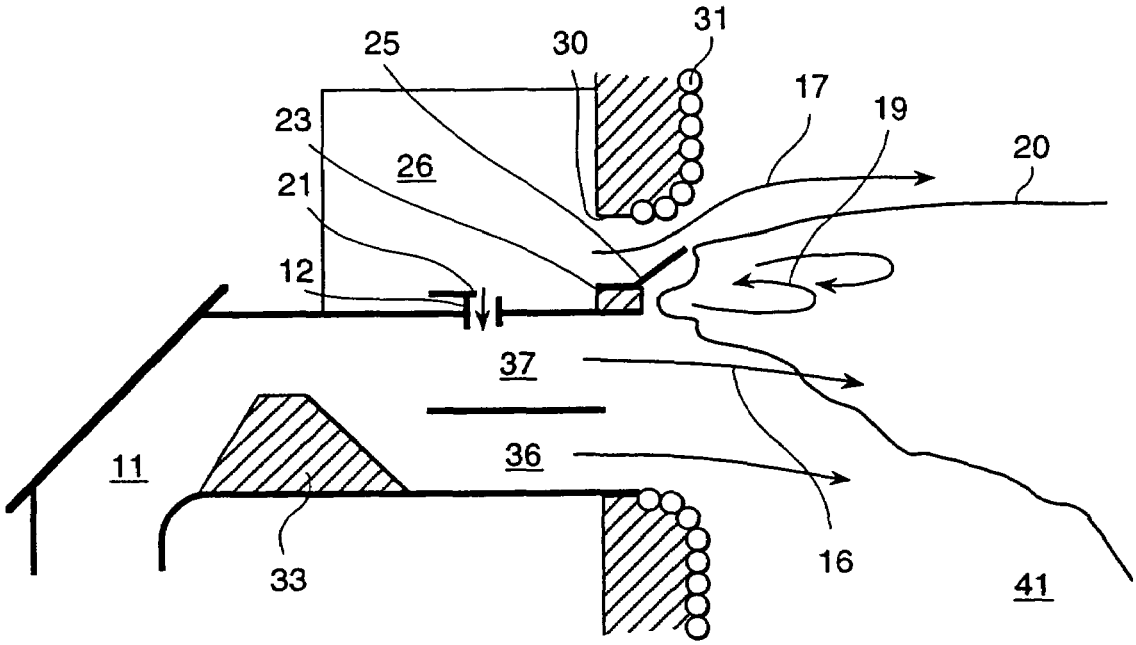
FIG. 9 is a cross-sectional view showing the structure of an embodiment 3 of a solid fuel burner in accordance with the present invention, and the view shows a state in which fuel ejected from the solid fuel burner under a low load condition is burning.

FIG. 9 is a cross-sectional view showing the structure of an embodiment 3 of a solid fuel burner in accordance with the present invention, and the view shows a state in which fuel ejected from the solid fuel burner under a low load condition is burning. Main different points of the present embodiment 3 from the embodiment 1 are that the fuel nozzle 11 is rectangular and that the air nozzle 13 is arranged beside the fuel nozzle 11.

The inside of the fuel nozzle 11 is constructed of an obstacle (concentrator) 33 and a separator 35 arranged in this order from the upstream side, and the obstacle 33 is set at a position on a separation wall opposite to the air nozzle 13 of the fuel nozzle 11. The additional air nozzle 12 is set in a direction that the air ejected toward the outer side separation wall 22 of the fuel nozzle 11 becomes nearly perpendicular to the flow direction of the mixed fluid flowing through the fuel nozzle 11. At that time, the exit of the additional air nozzle 12 is in a position overlapping with the separator 35 with respect to the axis of the burner.

An obstacle called as a flame stabilizing ring 23 is arranged in the front end portion, that is, the furnace exit side of the separation wall 22 separating between the fuel nozzle 11 and the air nozzle 13. The flame stabilizing ring 23 serves as a obstacle to the fuel jet 16 composed of the fuel and the transporting gas ejected from the fuel nozzle 11 and to the flow 17 of the air flowing through the air nozzle 13. Therefore, pressure in the downstream side (the furnace 41 side) of the flame stabilizing ring 23 is decreased, and a flow to a direction opposite to the fuel jet 16 and the flow 17 of air is induced in this portion. This opposite direction flow is called as the circulation flow 19.

The flame 20 is apt to be formed from the downstream of the separation wall 22 separating the fuel nozzle 11 and the air nozzle 12 where the air ejected from the air nozzle 13 and the fuel particles are easily mixed. By arranging the flame stabilizing ring 23 downstream of this separation wall 22, high temperature combustion gas from the inside of the furnace 41 stagnates in the circulation flow 19. The high temperature gas and the fuel in the fuel jet 16 are mixed at the exit of the solid fuel burner, and the temperature of the fuel particles is further increased by the radiant heat from the furnace 41 to ignite the fuel particles.

In the air nozzle 13 side of the flame stabilizing ring 23, a guide 25 is formed so that the air flow 17 may be ejected toward a direction having an angle with respect to the direction of the fuel jet 16. The direction of the air jet is guided toward the direction departing from the center axis of the burner by arranging the guide 25. Therefore, it is useful to form the circulation flow 19 by decreasing the pressure in the downstream side of the flame stabilizing ring 23.

The present embodiment 3 has the additional air nozzle 12 for ejecting air in the fuel nozzle 11 toward the direction nearly perpendicular to the direction of the fuel jet. When the additional air jet 21 ejected from the additional air nozzle 12 is ejected nearly perpendicular to the direction of the fuel jet, the speed difference between the fuel particles and the air becomes larger than the speed difference when the additional air jet 21 is ejected in parallel to the direction of the fuel jet to accelerate the mixing. Particularly, since the density of the fuel particles is larger than that of gas, the fuel particles are mixed into the additional air jet.

Further, in the present embodiment 3, the exit of the additional air nozzle 12 is in the position overlapping with the separator 35 with respect to the axis of the burner. The ejected direction of the additional air jet 21 is blocked by the separator 35 to flow through the flow passage 37 in the air nozzle side of the separator 35.

The flow passage 37 in the air nozzle side of the separator 35 has a flow resistance larger than that of the flow passage 36 in the opposite side because the additional air jet 21 is mixed. When the amount of the additional air is increased, the amount of the transporting gas flowing through the flow passage 37 in the air nozzle side is decreased. On the other hand, the fuel particles flow into the outer side flow passage 37 regardless of the flow resistance because the inertia force of the fuel particles is larger than that of gas. Therefore, the amount of the fuel particles is almost unchanged.

Therefore, when the amount of the additional air is increased, the amount of the transporting gas entering into the flow passage 37 in the air nozzle side together with the fuel particles in decreased. Since the transporting gas is replaced by the additional air, dilution of the oxygen concentration is smaller compared to the case where the transporting gas and the additional air are simply mixed, and accordingly the oxygen concentration becomes higher. Further, the separator 35 can prevent the fuel particles from being dispersed by disturbance produced at mixing of the additional air and the transporting gas. As the result, the oxygen concentration becomes high in the flow passage 37 in the air nozzle side.

Further, a velocity component toward the outer side separation wall 22 of the fuel nozzle is induced in the fuel transporting gas and the fuel particles by the obstacle (the concentrator) 33. The fuel particles flow along the flow passage 37 in the air nozzle side of the separator 35 because of the large inertia force to increase the fuel density in this zone.

Embodiment 4

Figure 10:
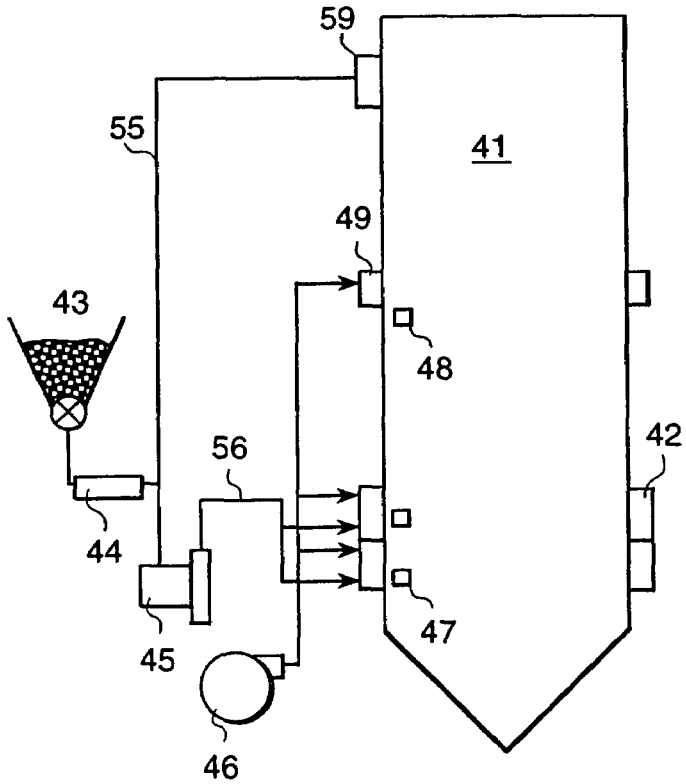
FIG. 10 is a schematic view showing the structure of a combustion apparatus using the solid fuel burner in accordance with the present invention.
Figure 11:
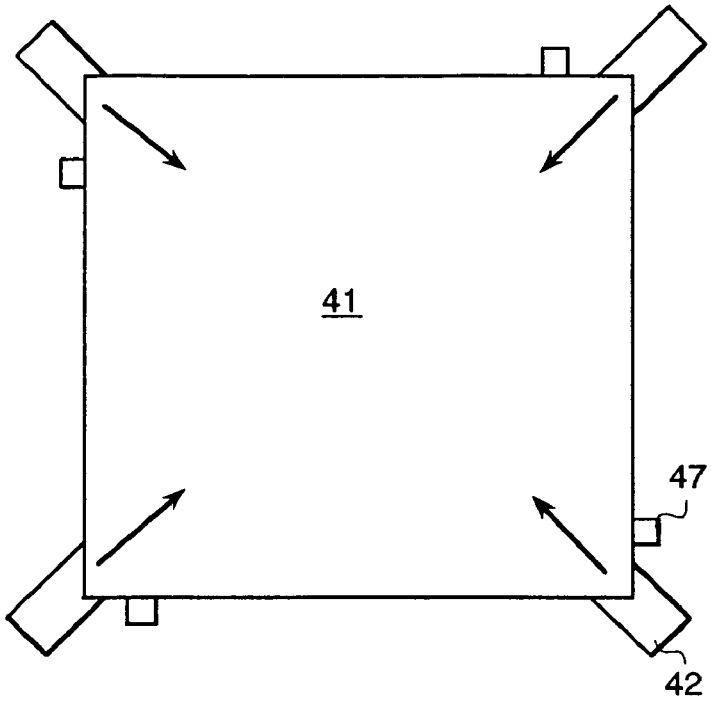
FIG. 11 is a horizontal cross-sectional view of the combustion apparatus of FIG. 10.

FIG. 10 is a schematic view showing the structure of a combustion apparatus using the solid fuel burner in accordance with the present invention, and FIG. 11 is a horizontal cross-sectional view of the furnace of FIG. 10.

In the present embodiment 4, the solid fuel burners 42 are arranged in two stages in the vertical direction of the combustion apparatus (furnace) 41 and in the four corners of the combustion apparatus 41 in the horizontal direction, the solid fuel burners 42 being directed toward the center. The fuel is supplied from a fuel hopper 43 to a pulverizer 45 through a coal feeder 44. At that time, the fuel is mixed with the combustion exhaust gas extracted from an upper portion of the combustion apparatus 41 in a combustion exhaust gas pipe 55 in the downstream side of the coal feeder 44, and then introduced into the pulverizer 45.

As the fuel is mixed with the high temperature combustion exhaust gas, the water component contained in the fuel is evaporated. Further, since the oxygen concentration is reduced, self-ignition and explosion of the mixture of the fuel and the gas can be suppressed even if the temperature of the mixture becomes high when the fuel is pulverized by the pulverizer 45. In the case of blown coal, the oxygen concentration is 6 to 15% in most cases. Air is supplied from a blower 46 to the solid fuel burners 42 and an after air port 49 arranged in the downstream side of the solid fuel burners 42.

The present embodiment 4 employs the two-stage combustion method that an amount of air less than the amount of air necessary for complete combustion of the fuel is input to the solid fuel burners 42, and then the remaining air is supplied from the after air port 49.

The present invention can be also applied to the single combustion method that an amount of air necessary for complete combustion of the fuel is input to the solid fuel burners 42 without providing any after air port 49.

The present embodiment 4 does not comprise any temporary fuel storage portion between the pulverizer 45 and the solid fuel burner 42.

Embodiment 5

Figure 12:
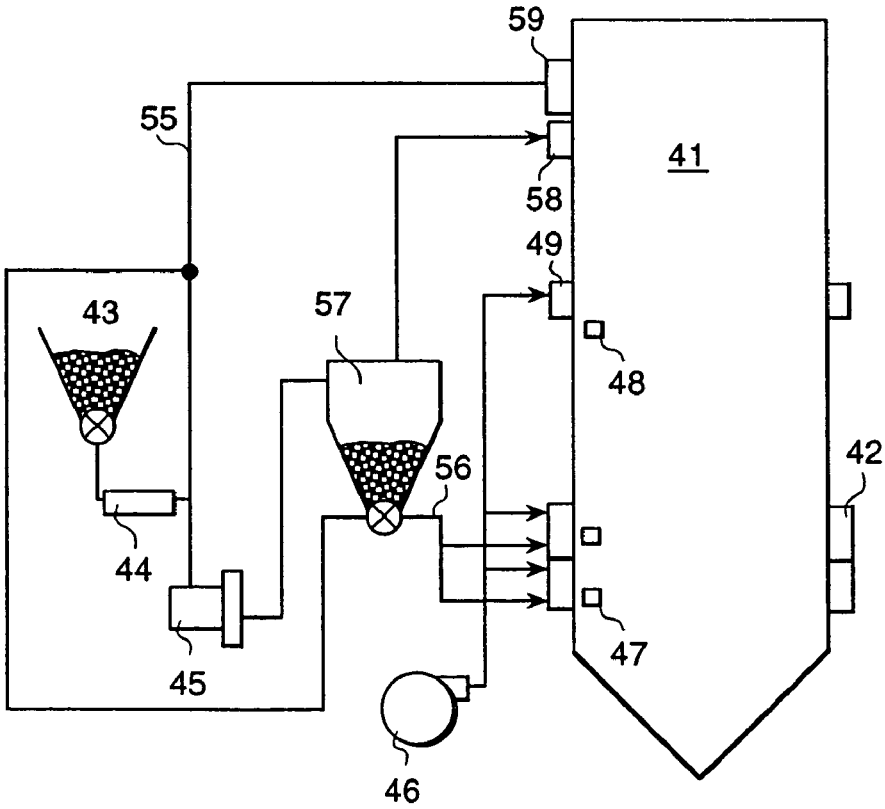
FIG. 12 is a schematic view showing the structure of another example of a combustion apparatus using the solid fuel burner in accordance with the present invention.

FIG. 12 is a schematic view showing the structure of another example of a combustion apparatus using the solid fuel burner in accordance with the present invention. The present invention can be also applied to the fuel supply method that a fuel hopper 57 is arranged between the pulverizer 45 and the solid fuel burner 57, and different gases are used for the transporting gas flowing through a pipe 55 from the pulverizer 45 to the fuel hopper 57 and for the transporting gas flowing in the pipe 56 from the hopper 57 to the solid fuel burner 42.

In the fuel supply method shown in FIG. 12, the transporting gas having a thermal capacity grown by evaporation of moisture contained in the fuel particles inside the pipe 55 is separated by the fuel hopper portion, and then is input into the furnace 41 through the downstream side of the solid fuel burner 42 of the furnace 41.

Since the water contained in the transporting gas supplied to the solid fuel burner 42 is reduced by separating the transporting gas as described above, the flame temperature of the flame 20 formed by the solid fuel burner 42 is increased to reduce amounts of the nitrogen oxides and the unburned components or unburned carbons.

When the solid fuel is burned with high combustion load, there are some cases in which combustion ash attaches on to the structures of the solid fuel burner and the wall of the furnace to cause a phenomenon called as slugging in which the attached substance is growing. In a case where there is high possibility of occurrence of slugging, the slugging can be suppressed by changing the combustion method of the solid fuel burner corresponding to the combustion load.

That is, under the high load condition, the flame 20 is formed at a position distant from the solid fuel burner 42 to reduce the thermal load near the solid fuel burner 42. On the other hand, under the low load condition, the flame 20 is formed from a position near the exit of the fuel nozzle 11. In such a combustion method, it is necessary to monitor the flame 20 in order to safely operate the combustion apparatus.

In the present invention, it is preferable that the monitoring method is also changed because the combustion method is changed corresponding to the load. That is, under the low load condition, in order to monitor the flame 20 formed in each of the solid fuel burners 42, load flame detectors 47 are individually arranged in the solid fuel burners 42. On the other hand, under the high load condition, a load flame detector 48 for monitoring the central portion of the combustion apparatus needs to be installed because the flame 20 is formed at positions distant from the solid fuel burner 42. The flames are monitored by selecting signals of the flame detectors 47 and 48 corresponding to the load and the combustion method.

Further, in order to reduce an amount of slug attached to the structures of the solid fuel burners and the wall of the furnace 41 under the high load condition, it is possible that thermometers or radiation pyrometers are arranged on the wall of the furnace 41 and in the solid fuel burners 42, and the flow rate of the additional air is controlled based on the signals of the thermometers or the radiation pyrometers.

Embodiment 6

Figure 13:
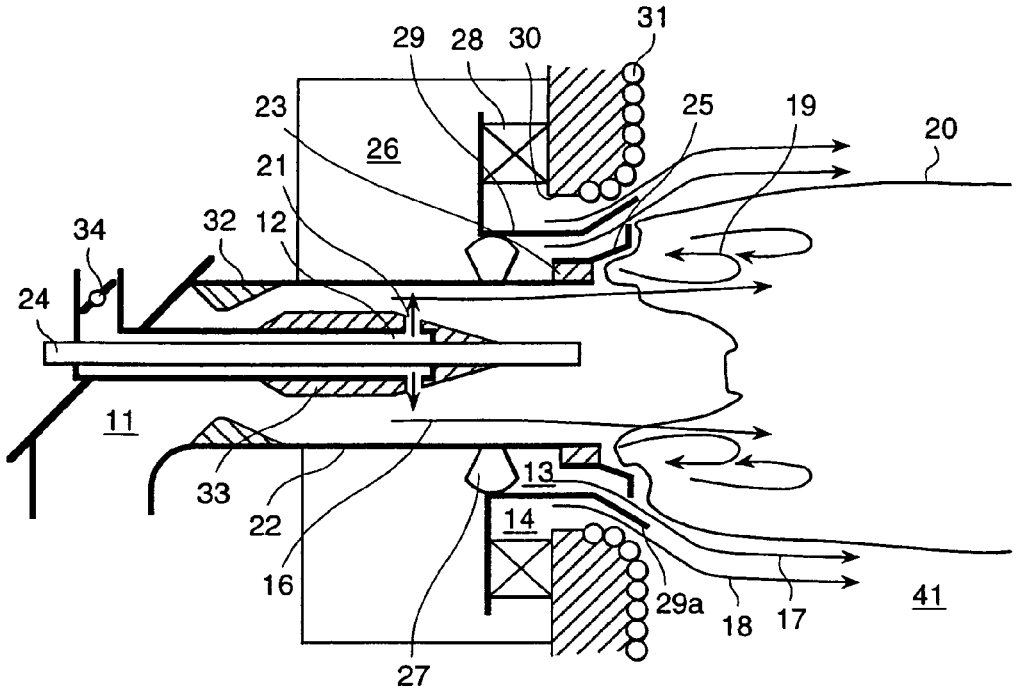
FIG. 13 is a cross-sectional view showing the structure of an embodiment 6 of a solid fuel burner in accordance with the present invention, and the view shows a state in which the flame of the solid fuel burner is formed near a circulation flow in the downstream side of a flame stabilizing ring when the embodiment 6 of the solid fuel burner is used under a low load condition.
Figure 14:
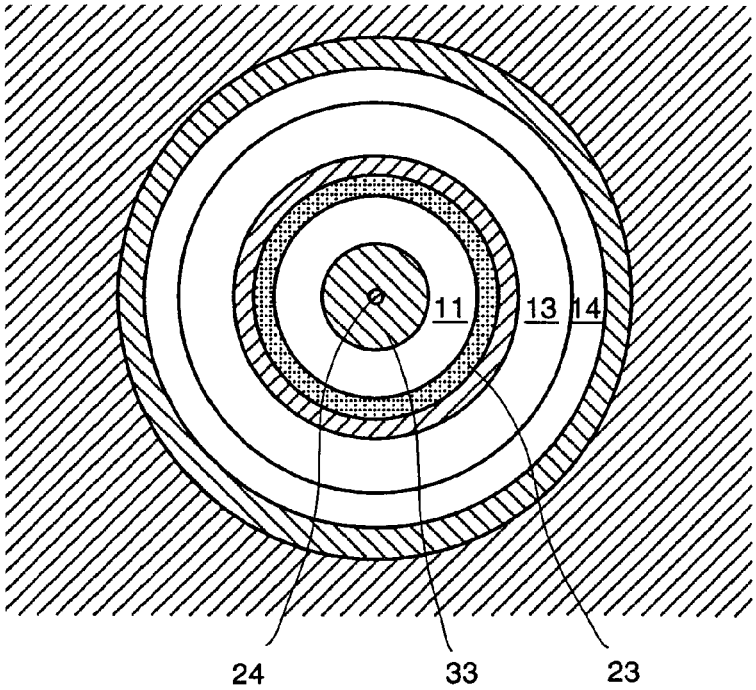
FIG. 14 is a schematic view showing the structure of the embodiment 6 of the solid fuel burner seeing from the inner side of a combustion apparatus.

FIG. 13 is a cross-sectional view showing the structure of an embodiment 6 of the solid fuel burner in accordance with the present invention, FIG. 14 is a schematic view showing the structure of the solid fuel burner seeing from the inner side the combustion apparatus 41.

The solid fuel burner of the present embodiment 6 comprises a combustion improving oil gun 24 in the central portion, and a fuel nozzle 11 for ejecting the mixed fluid of the fuel and the transporting gas of the fuel around the combustion improving gun 24. A plurality of additional air nozzles 12 are arranged in the directions that the nozzle exits are directed from an outer side separation wall 22 of the fuel nozzle 11 toward the center axis of the solid fuel burner.

The combustion improving gun 24 arranged so as to penetrate the central portion of the fuel nozzle is used for igniting the fuel at starting the solid fuel burner.

Outside the fuel nozzle 11, there are the annular outer side air nozzles (a secondary air nozzle 13, a tertiary air nozzle 14) for ejecting air, and the annular outer side air nozzles are concentric to the fuel nozzle 11.

An obstacle called as a flame stabilizing ring 24 is arranged in the front end portion of the fuel nozzle, that is, in the exit side to the combustion apparatus. The flame stabilizing ring 23 serves as an obstacle to the fuel jet 16 composed of the fuel and the transporting gas ejected from the fuel nozzle 11 and the secondary air flow 17 flowing through the secondary air nozzle 13. Therefore, the pressure in the downstream side of the flame stabilizing ring 23, that is, in the combustion apparatus 41 side is decreased, and flow toward the direction opposite to the direction of the fuel jet 16 and the secondary air flow is induced. The opposite direction flow is defined as a circulation flow 19.

High temperature gas produced by combustion of fuel flows into the inside of the circulation flow 19 from the downstream side, and is stagnated in the circulation flow 19. As the high temperature gas and the fuel in the fuel jet 16 are mixed inside the combustion apparatus at the exit of the solid fuel burner, the temperature of the fuel particles are increased by the radiant heat from the inside of the combustion apparatus 41 to be ignited.

The secondary air nozzle 13 and the tertiary air nozzle 14 are separated from each other by a separating wall 29, and the front end portion of the separating wall 29 is formed in a guide 25 for ejecting the flow of the tertiary air 18 so as to have an angle to the fuel jet 16. If a guide 25 for guiding the ejecting direction of the outer side air toward the direction departing from the center axis of the burner is arranged at the exit of the flow passages of the outer air nozzles (the secondary air nozzle 13 and the tertiary air nozzle 14), the guide is useful for easily forming the circulation flow 19, together with the flame stabilizing ring 23.

In order to add swirling force to the air ejected from the secondary air nozzle 13 and the tertiary air nozzle 14, swirlers 27 and 28 are arranged in the nozzles 13 and 14.

A burner throat 30 composing the wall of the combustion apparatus also serves as an outer peripheral wall of the tertiary air nozzle. Water pipes 31 are arranged in the wall of the combustion apparatus.

In the present embodiment 1, the oxygen concentration in the fuel jet 16 flowing through the fuel nozzle 11 is lowered using the combustion exhaust gas for the transporting gas of the fuel. As an example to which such a combustion method is applied, there is combustion of blown coal or lignite.

Blown coal and lignite are low in calorific value compared to coal of a high coalification rank such as bituminous coal and anthracite, and are generally low in grindability or pulverizability. Furthermore, combustion ash of these solid fuels is low in melting temperature. Since these solid fuels contain much volatile matters, these solid fuels easily self-ignite in a storage process and a pulverizing process under air atmosphere, and accordingly are difficult to be handled compared to bituminous coal. In a case where blown coal or lignite is pulverized to be burned, a mixed gas of combustion exhaust gas and air is used as a transporting gas of the fuel in order to prevent these fuels from self-igniting. The combustion exhaust gas reduces the oxygen concentration to prevent the fuel from self-burning. On the other hand, the retention heat of the combustion exhaust gas evaporates the moisture in the fuel.

Under a low oxygen concentration atmosphere, combustion speed is slower compared to combustion speed under air atmosphere. When pulverized coal such as blown coal or lignite is transported using the transporting gas of a low oxygen concentration, the combustion speed is limited by the mixing speed of the fuel and air, and the combustion speed is decreased lower compared to bituminous coal which can be transported by air. Therefore, when blown coal or lignite is burned by a solid fuel burner under a low load condition in which the burned amount of fuel is small, blow-off of the flame 20 or flameout is apt to occur compared to the case of bituminous coal.

The present embodiment 6 comprises the additional air nozzles 12 for ejecting air toward the direction nearly perpendicular to the flow direction of the fuel jet inside the fuel nozzle. When the air jet (the additional air jet) 21 ejected from the additional air nozzle 12 is ejected toward the direction nearly perpendicular to the flow direction of the fuel jet, the mixing between the fuel jet and the additional air is progressed because the speed difference between the fuel particles and the additional air jet is larger than the speed difference in the case where the additional air jet ejected from the additional air nozzle is ejected in parallel to the direction of the fuel jet. Particularly, since the specific density of the fuel particle is larger than that of air, the fuel particles are mixed into the additional air jet by an inertia force.

At that time, since the transporting gas (low oxygen concentration) around the fuel particles is separated from the fuel particles, the oxygen concentration around the fuel particles becomes higher than the oxygen concentration of the transporting gas. Therefore, after ejected from the fuel nozzle, the combustion reaction is accelerated by the high oxygen concentration, and accordingly flame 20 is stably formed at the exit of the fuel nozzle.

In order to prevent back fire or burnout by forming flame 20 inside the fuel nozzle 11, it is preferable that the distance from the exit of the fuel nozzle to the exit of the additional air nozzle 12 is a length capable of making the fuel retention time in the fuel nozzle shorter than the ignition lag time of the fuel (approximately 0.1 second). Since the fuel transporting gas generally flows inside the fuel nozzle at a flow speed of 12 to 20 m/s, the distance from the exit of the fuel nozzle to the exit of the additional air nozzle is shorter than 1 m.

Further, in the present embodiment 6, a flow passage contracting member 32 for contracting the flow passage provided inside the fuel nozzle 11 is arranged in the outer side wall 22 upstream of the fuel nozzle 11. An obstacle (a concentrator) 33 for once contracting and then expanding the flow passage is arranged outside of the oil gun 24 in the fuel nozzle central portion inside the fuel nozzle 11. The obstacle 33 is arranged in the downstream side of the flow passage contracting member 32 in the solid fuel burner (the combustion apparatus 41 side).

The flow passage contracting member 32 induces the velocity component in the direction toward the center axis of the fuel nozzle in the fuel particles (the pulverized coal) of which the inertia force is larger than that of the fuel transporting gas. By arranging the concentrator 33 in the downstream side of the flow passage contracting member 32, the flow of the fuel particles (the pulverized coal) contracted toward the burner center axis direction by the flow passage contracting member 32 flows along the flow passage of the fuel nozzle toward the separation wall 22 after passed through the concentrator 33. The fuel particles (the pulverized coal) flowing along the flow passage inside the fuel nozzle unevenly flow in the side of the inner wall surface (in the side of the separating wall 22) toward the exit. Therefore, the fuel is enriched in the side of the inner wall surface of the fuel nozzle 11 (in the side of the separating wall 22).

Since the air ejected from the additional air nozzle is also ejected in the vicinity of the outer periphery (the separating wall 22) side in the fuel nozzle 11, a region of high fuel concentration and high oxygen concentration is formed. As the result, after the fuel is ejected from the fuel nozzle, the combustion reaction is accelerated by the high oxygen concentration to stably form flame 20 at the exit of the fuel nozzle. The fuel jet flowing in the vicinity of the outer periphery (separating wall 22) of the fuel nozzle 11 is easily mixed with the air ejected from the outer side air nozzle near the exit of the fuel nozzle 11.

Further, when the fuel jet is mixed with the high temperature gas of the circulation flow produced in the rear stream side of the flame stabilizing ring 23, temperature rise of the fuel particles is caused, and the fuel is apt to be ignited. As the result, the flame 20 is stably formed at the exit of the fuel nozzle.

By ejecting the air from the additional air nozzle 12 in the direction nearly perpendicular to the direction of the fuel jet flowing inside the fuel nozzle 11, as described above, the mixing between the fuel particles and the air is progressed, and the flame 20 is stably formed at the exit of the fuel nozzle. Therefore, combustion can be stably continued in a load lower than a conventional low load.

In the case where blown coal or lignite is burned with high thermal load, the amount of fuel burning at a position near the solid fuel burner is increased under a good mixing condition of air and the fuel because the fuel contains a large amount of volatile matters. When the thermal load near the solid fuel burner is locally increased to cause temperature rise of the structure of the solid fuel burner and the wall of the combustion apparatus by radiant heat from the flame 20, as described above, there is possibility to cause slugging by that combustion ash attaches and melts on the wall of the combustion apparatus. Particularly, blown coal and lignite are apt to cause slugging because of low melting temperature of the combustion ash.

In the present embodiment 6, the position of forming the flame 20 is changed corresponding to the load of the solid fuel burner to solve the trouble caused by the difference of the combustion state between under the high load condition and under the low load condition of the solid fuel burner when the fuel of a low coalification rank is used. That is, the flame 20 is formed at a position distant from the solid fuel burner when the load condition is high, and the flame 20 is formed from a position near the exit of the fuel nozzle 11 when the load condition is low. Under the low load condition, even if the flame 20 is brought close to the wall of the combustion apparatus or the solid fuel burner, the temperature of the solid fuel burner and the wall of the combustion apparatus around the solid fuel burner is lower than that in the case of the high load condition because of the low thermal load in the combustion apparatus 41. Therefore, the slugging does not occur.

In the present embodiment 6, when the load condition is low, the flame 20 is formed from a position near the exit of the fuel nozzle 11, and the high temperature gas is stagnated in the circulation flow 19 which is formed in the downstream side of the flame stabilizing ring 23 and the guide 25. Further, the oxygen concentration in the fuel jet 16 near the flame stabilizing ring 23 is increased by opening a flow control valve 34 of the additional air nozzle 12 to supply air. As the result, since the combustion speed becomes higher compared to the condition of low oxygen concentration, ignition of the fuel particles can be advanced to form the flame 20 near the fuel nozzle 11.

Under the high load condition, the flame 20 is formed at a position distant from the solid fuel burner to reduce the thermal load near the solid fuel burner. Therefore, in the present embodiment 6, the amount of supplied air is reduced compared to the case of the low load condition by closing the flow control valve 34 of the additional air nozzle 12. At the time, the oxygen concentration in the fuel jet 16 at the position near the flame stabilizing ring 23 becomes lower than that in the low load condition to make the combustion speed slower. Therefore, the temperature of the circulation flow produced in the downstream side of the flame stabilizing ring 23 is lowered to decrease the amount of radiant heat received by the structure of the solid fuel burner, and accordingly occurrence of slugging can be suppressed.

Figure 15:
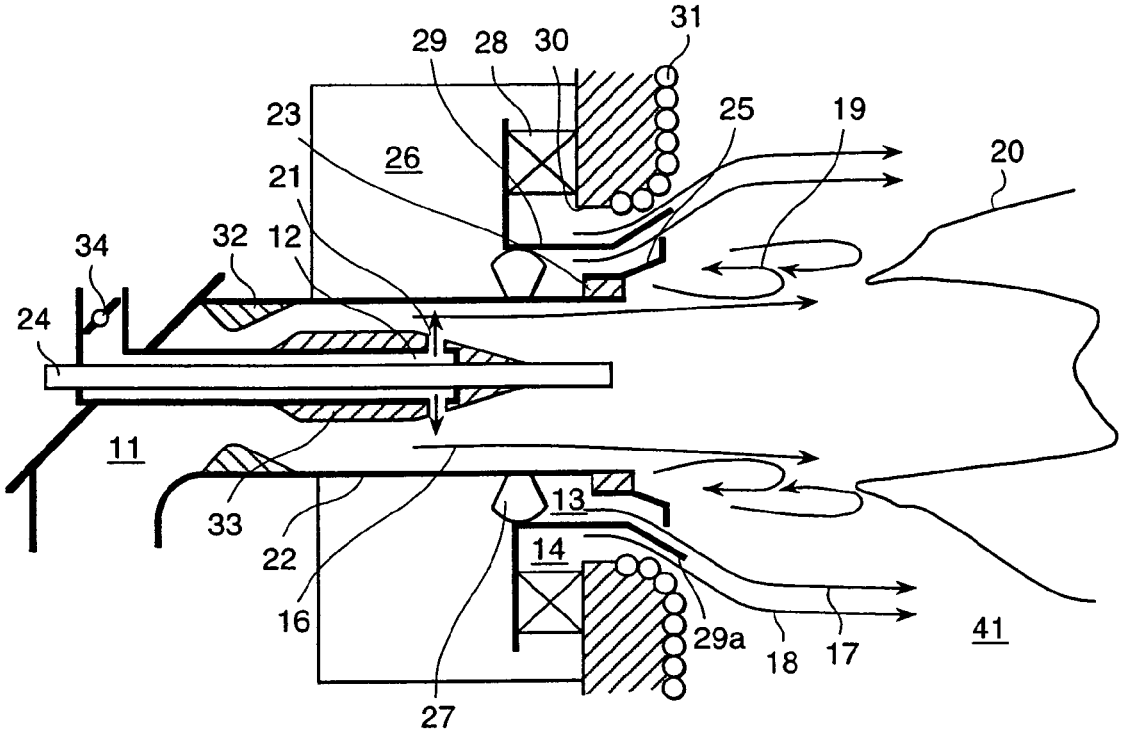
FIG. 15 is a view showing a state in which flame of the solid fuel burner is formed near the circulation flow in the downstream side of the flame stabilizing ring when the embodiment 6 of the solid fuel burner is used under a high load condition.

FIG. 15 is a view showing a state in which flame 20 of the solid fuel burner is formed separated from the circulation flow 19 in the downstream side of the flame stabilizing ring 23 when the embodiment 6 of the solid fuel burner is used under the high load condition.

A horizontal cross-section of a combustion apparatus using the embodiment 6 of the solid fuel burners 42 is the same as FIG. 4. When the solid fuel burners 42 are used under the high load condition as shown in FIG. 15, it is preferable that the flames 20 are mixed with one another inside the combustion apparatus 41 in order to reduce probability of occurrence of flameout.

In order to reduce nitrogen oxides NOx produced by combustion, it is preferable that the amount of air is controlled so that a ratio of the total amount of air supplied from the additional air nozzle and supplied from the additional air nozzle to the amount of air necessary for completely burning the volatile matters may becomes 0.85 to 0.95.

Most of fuel is burned by mixed with air supplied from the above-described nozzles contained in the fuel nozzle 11 (the first step), and then burned by being mixed with the secondary air flow 17 and the tertiary air flow 18 (the second step). Further, in a case where an after air port 49 (refer to FIG. 10) for supplying air into the combustion apparatus 41 is arranged in the downstream side of the solid fuel burner, the fuel is completely burned by being mixed with air supplied from the after air port 49 (the third step). The volatile matters in the fuel are burned in the first step described above because the combustion speed of the volatile matters is faster than that of the solid fuel.

At that time, when the air ratio to the volatile matters is set to 0.85 to 0.95, combustion of the fuel can be accelerated to be burned by high flame temperature though the condition is lacking in oxygen. Since the fuel is reduction-burned under lacking of oxygen in the combustion in the first step, the nitrogen oxides (NOx) produced from nitrogen in the fuel and nitrogen in air are converted to harmless nitrogen, and accordingly, the amount of NOx exhausted from the combustion apparatus 41 can be reduced. Since the fuel reacts under high temperature, the reaction of the second step is accelerated to reduce the amount of unburned components.

As shown in FIG. 14 of the solid fuel burner seeing from the side of the combustion apparatus, the solid fuel burner of the present embodiment 6 is cylindrical in which the cylindrical fuel nozzle 11, the cylindrical secondary nozzle 13 and the cylindrical tertiary nozzle are concentrically arranged.

Figure 16:
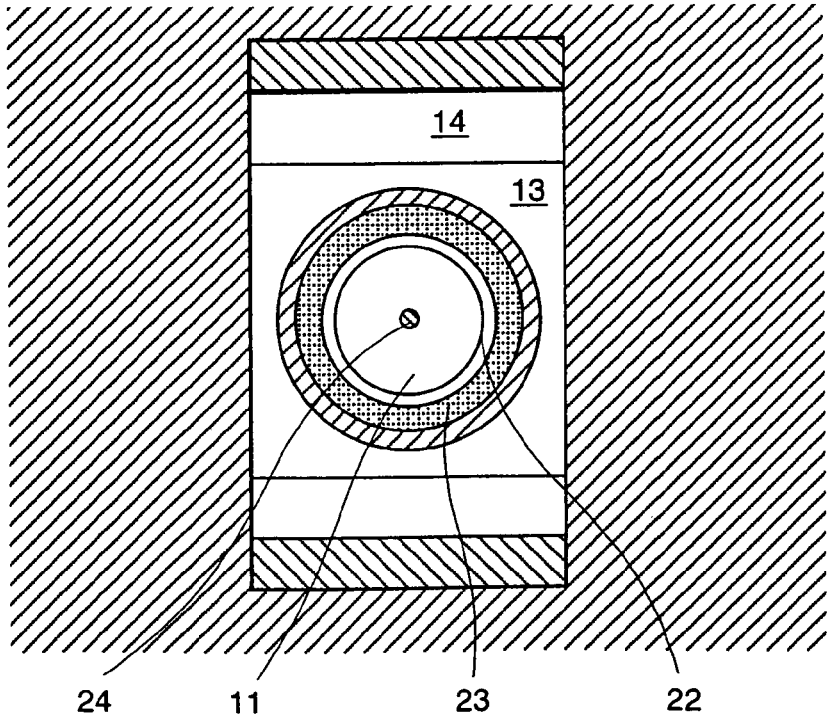
FIG. 16 is a view showing another example of a nozzle part of the solid fuel burner.

FIG. 16 is a view showing another example of a nozzle part of the solid fuel burner. The fuel nozzle 11 may be rectangular, the concentrator 33 may be triangular, or the air nozzle structure that the fuel nozzle is put between at least part of the outer side air nozzles such as the secondary air nozzle 13, the tertiary air nozzle 14 etc may be acceptable. Further, the outer side air may be supplied from a single nozzle, or the nozzle structure of divided into three or more parts may be acceptable.

Embodiment 7

Figure 17:
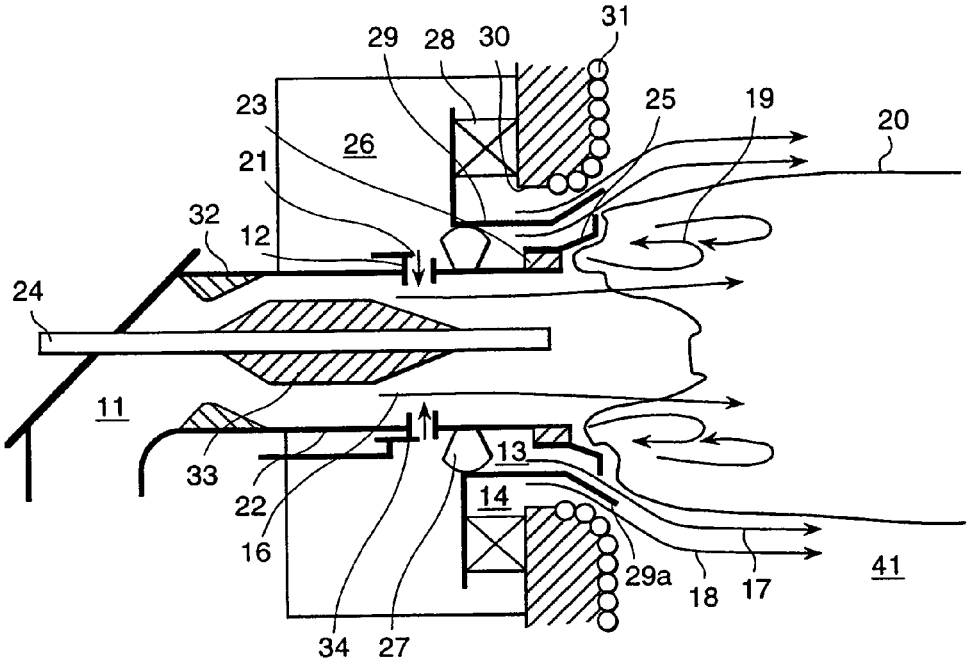
FIG. 17 is a cross-sectional view showing an embodiment 7 of a solid fuel burner in accordance with the present invention, and in the solid fuel burner, the installation position of the additional air nozzle is changed.

FIG. 17 is a cross-sectional view showing an embodiment 2 of a solid fuel burner in accordance with the present invention in which the installation position of the additional air nozzle is changed. As shown in FIG. 17, the additional air nozzle 12 may eject air from the separation wall in the periphery of the fuel nozzle toward the center instead of ejecting air from the inside of the fuel nozzle toward the outer side as shown in FIG. 13.

It is preferable that the additional air nozzle 12 is arranged in the portion where the flow passage of the fuel nozzle 11 expands. By arranging the exits of the additional air nozzle 12 in the flow passage expanding portion where a velocity component flowing from the flow passage toward the wall surface is hardly induced, it is possible to suppress the fuel particles from entering into or accumulated in the additional air nozzle.

In order to prevent occurrence of burnout and backfire phenomena of the fuel nozzle 11 caused by igniting the fuel inside the fuel nozzle 11, it is preferable to determine arrangement of the additional air nozzle 12 so that the retention time of fuel in the fuel nozzle 11 may be shorter than the lag time of ignition. In general, the index of the ignition time lag of gas fuel is approximately 0.1 second which is shorter than the ignition time lag of pulverized coal, and the index of flow speed inside the fuel nozzle 11. For example, the distance between the exit of the fuel nozzle 11 and the exit of the additional air nozzle 12 is set to a value smaller than about 1 m.

Embodiment 8

Figure 18:
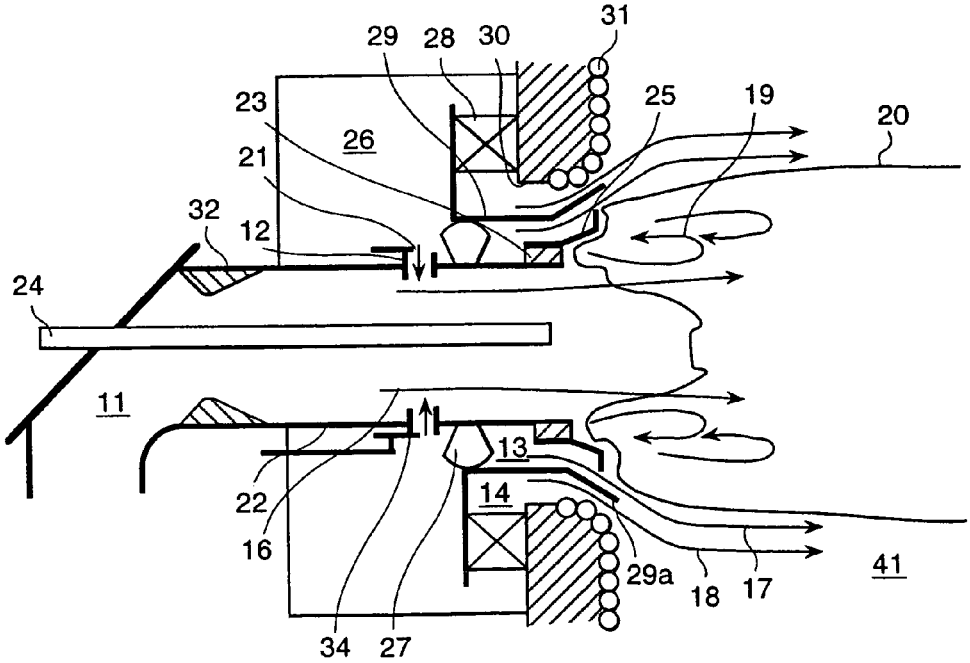
FIG. 18 is a cross-sectional view showing an embodiment 8 of a solid fuel burner in accordance with the present invention, and the solid fuel burner does not have a concentrator.

FIG. 18 is a cross-sectional view showing the structure of an embodiment 8 of a solid fuel burner which does not have a concentrator 33. In the embodiment 6, the concentrator 33 is arranged in the fuel nozzle 11. However, as shown in FIG. 18, when air is ejected from the additional air nozzle in the direction nearly perpendicular to the direction of the fuel jet flowing inside the fuel nozzle 11, the fuel jet and the air are mixed with each other similarly to the case of the embodiment 1 even without the concentrator 33.

Embodiment 9

Figure 19:
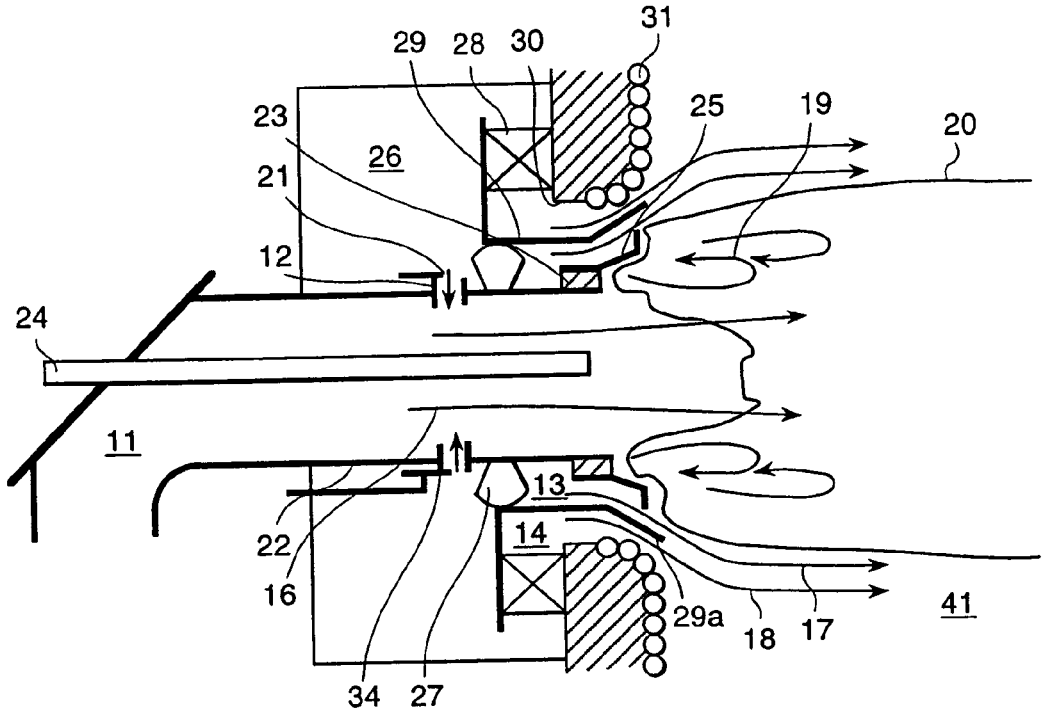
FIG. 19 is a cross-sectional view showing the structure of an embodiment 9 of a solid fuel burner in accordance with the present invention, and the view shows a state in which fuel ejected from the solid fuel burner under a low load condition is burning.
Figure 20:
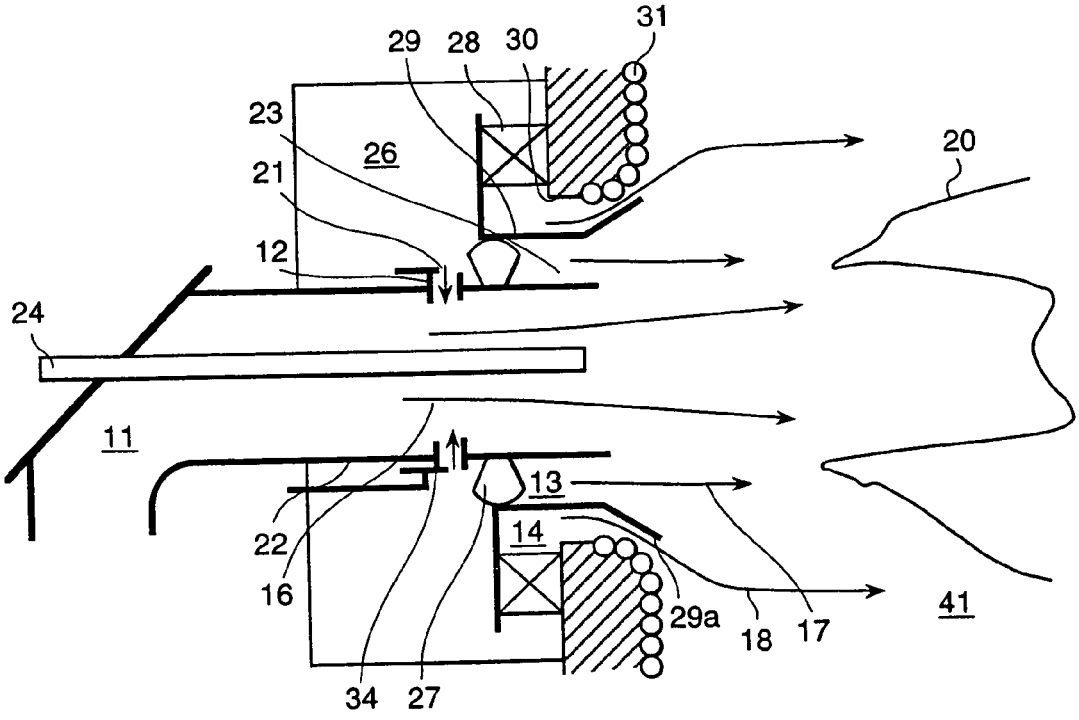
FIG. 20 is a cross-sectional view showing the structure of an embodiment 9 of a solid fuel burner in accordance with the present invention, and the view shows a state in which fuel ejected from the solid fuel burner under a high load condition is burning.

FIG. 19 and FIG. 20 each are a cross-sectional view showing the structure of an embodiment 9 of a solid fuel burner in accordance with the present invention. FIG. 19 shows a state in which fuel ejected from the solid fuel burner under a low load condition is burning in the combustion apparatus 41, and FIG. 20 shows a state in which fuel ejected from the solid fuel burner under a high load condition is burning in the combustion apparatus 41.

A main difference between the present embodiment 9 and the embodiment 6 is that the flame stabilizing ring 23 and the guide 25 are not arranged in the front end portion of the outer side separation wall 22 of the fuel nozzle 11. In the present embodiment 9, a swirler 27 arranged in the secondary air flow passage is used in order to vary the shape of the flame 20 without the flame stabilizing ring 23 and the guide 25.

Under the low load condition, the oxygen concentration in the fuel jet 16 is increased near the outer side separation wall 22 of the fuel nozzle 11 by supplying air from the additional air nozzle 12. Since the combustion speed is increased compared to the case of the low oxygen concentration, ignition of the fuel particles is advanced to form the flame 20 from a position near the fuel nozzle 11.

In the present embodiment 9, a strong swirling velocity (generally, 1 or more in swirl number) is added to the secondary air using a swirler 27 arranged in the secondary flow passage. After ejected from the secondary air nozzle 13, the flow of the secondary air 17 is expanded toward the direction departing from the fuel jet 16 by the centrifugal force by the swirling velocity. At that time, pressure in the zone between the fuel jet 16 and the secondary air flow 17 is decreased to induce the circulation flow which flows toward the direction opposite to the flow direction of the fuel jet 16 and the secondary air flow 17. When the flow rate of the secondary air flow is reduced to nearly zero by attaching a damper for decreasing the flow rate in the secondary air flow passage, a circulation flow can be induced between the secondary air flow 18 and the fuel jet 16.

In the high load condition, the flame 20 is formed in a position distant from the solid fuel burner to reduce the thermal load around the solid fuel burner. Therefore, the amount of supplied air from the additional air nozzle 12 is reduced. As the supplied amount of the additional air is reduced, the oxygen concentration in the fuel jet 16 near the outer side separation wall 22 of the fuel nozzle 11 is lowered compared to the low load condition to make the combustion speed slower.

Further, in the present embodiment 9, the swirl velocity added to the secondary air is weakened using the swirler 27 arranged in the secondary air flow passage. Since the flow of the secondary air 17 flows in parallel to the fuel jet 16 after ejected from the secondary air nozzle 13, the circulation flow 19 of opposite direction flow is not produced in the zone between the fuel jet 16 and the secondary air flow 17. By opening the damper attached to the secondary flow passage to increase the flow rate of the secondary air, it is possible to prevent occurrence of the circulation flow 19 of opposite direction flow in the zone between the fuel jet 16 and the secondary air flow 17.

Figure 21:
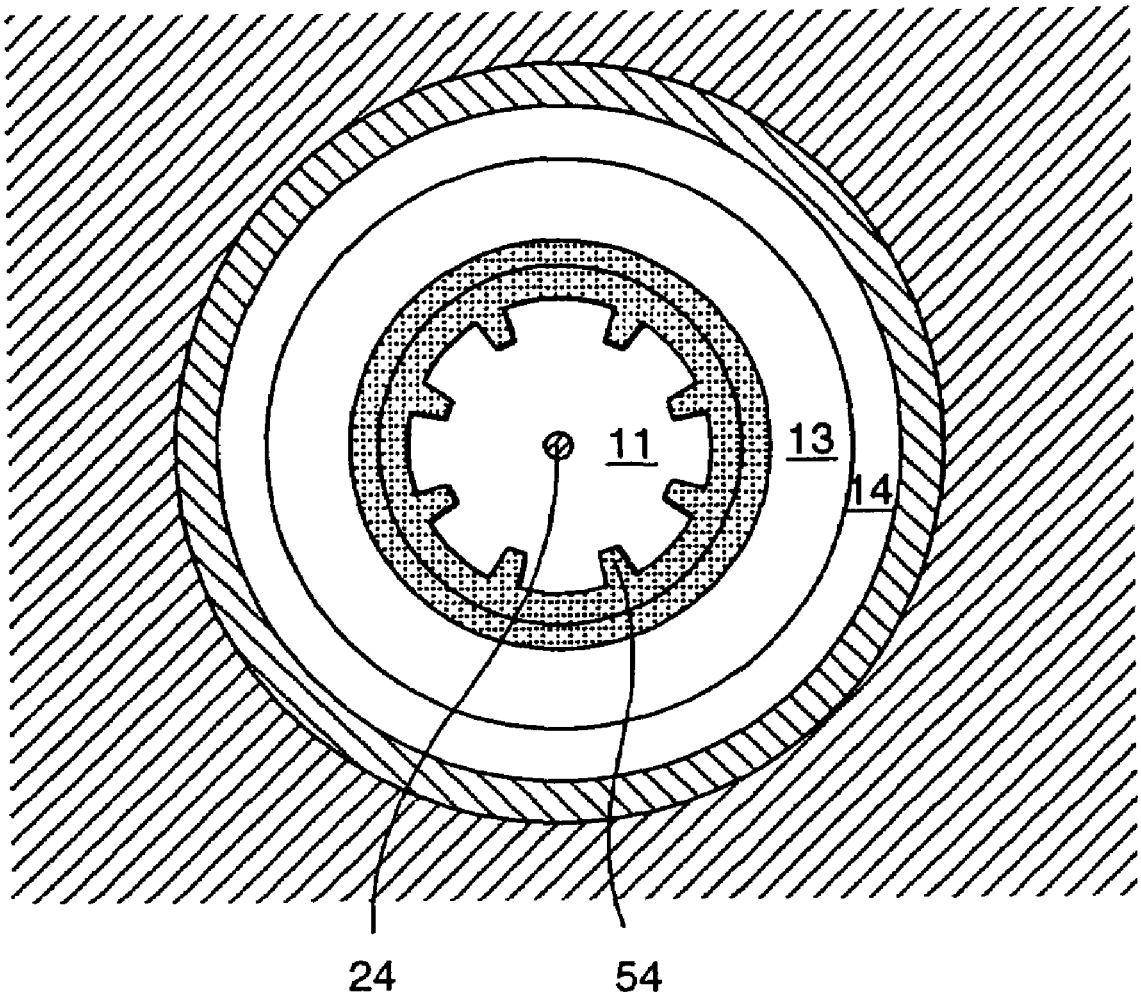
FIG. 21 is a view showing an example of another structure of the flame stabilizing ring.

FIG. 21 is a view showing an example of another structure of the flame stabilizing ring. In the present embodiment 9, a toothed flame stabilizing ring 54 may be arranged, as shown in FIG. 21. The fuel flows around to the back of the toothed flame stabilizing ring 54 to be easily ignited. That is, the fuel is ignited in the back side of the toothed flame stabilizing ring 54.

The structure of a combustion apparatus using the solid fuel burner shown in the embodiments 6 to 9 is the same as in FIGS. 10 and 11.

According to the present invention, it is possible to provide a solid fuel burner which comprises a means for accelerating mixing between the fuel particles and air inside the fuel nozzle to stably burn the fuel and to prevent occurrence of slugging caused by combustion ash over a wide range from a high load condition to a low load condition without changing a distance from the exit of the additional air nozzle to the exit of the fuel nozzle even using a solid fuel having comparatively low combustibility, that is, coal of a low coalification grade such as brown coal, lignite or the like.

Further, it is possible to provide the combustion method using the solid fuel burner comprising the means for accelerating mixing between the fuel particles and air to stably burn the fuel and for preventing occurrence of slugging caused by combustion ash, and to provide the combustion apparatus comprising the solid fuel burner, the method of operating the combustion apparatus comprising the solid fuel burner, and the coal-fired boiler comprising the solid fuel burner.

What is claimed is:

1. A solid fuel burner comprising:

a fuel nozzle for ejecting a mixed fluid of a solid fuel and a transporting gas having an oxygen concentration lower than an oxygen concentration of air;

an outside air nozzle for ejecting air from an outside of said fuel nozzle;

portions contracting and expanding a flow passage inside said fuel nozzle; and an additional air nozzle for ejecting air and a separator dividing a flow passage inside said fuel nozzle, each provided inside said fuel nozzle, an outlet of said additional air nozzle being placed at a position that the outlet overlaps said separator which is positioned to block air ejected from said additional air nozzle when viewed in a direction perpendicular to the fuel jet direction at the separator, and said fuel nozzle having a constant area from a downstream end of said separator to the outlet of said fuel nozzle, wherein an obstacle for obstructing a flow of solid fuel and transporting air ejected from said fuel nozzle and a flow of air ejected from said outside air nozzle is provided at a downstream end of a separation wall separating said fuel nozzle and said outside air nozzle.

2. A solid fuel burner comprising:

a fuel nozzle for ejecting a mixed fluid of a solid fuel and a transporting gas having an oxygen concentration lower than an oxygen concentration of air;

an outside air nozzle for ejecting air from an outside of said fuel nozzle;

portions contracting and expanding a flow passage inside said fuel nozzle; and an additional air nozzle for ejecting air and a separator dividing a flow passage inside said fuel nozzle each provided inside said fuel nozzle, with an outlet of said additional air nozzle positioned so that the outlet overlaps said separator which is positioned to block air ejected from said additional air nozzle when viewed in a direction perpendicular to the fuel jet direction at the separator, and said fuel nozzle having a constant area from a downstream end of said separator to the outlet of said fuel nozzle, so that the concentration of oxygen is raised at an outer peripheral portion of a cross-sectional area of an outlet of said fuel nozzle than a central portion thereof; and wherein an obstacle for obstructing a flow of solid fuel and transporting air ejected from said fuel nozzle and a flow of air ejected from said outside air nozzle is provided at a downstream end of a separation wall separating said fuel nozzle and said outside air nozzle.

3. A solid fuel burner comprising:

a fuel nozzle for ejecting a mixed fluid of a solid fuel and a transporting gas having an oxygen concentration lower than an oxygen concentration of air;

an outside air nozzle for ejecting air from an outside of said fuel nozzle;

portions contracting and expanding a flow passage inside said fuel nozzle; and an additional air nozzle for ejecting air and a separator dividing a flow passage inside the fuel nozzle, each provided inside said fuel nozzle, with an outlet of the additional air nozzle being positioned such that the outlet overlaps the separator which is positioned to block air ejected from said additional air nozzle when viewed in a direction perpendicular to the fuel jet direction at the separator, and said fuel nozzle having a constant area from a downstream end of said separator to the outlet of said fuel nozzle, so that the concentration of oxygen and the concentration of fuel are raised at an outer peripheral portion of a cross-sectional area of an outlet of said fuel nozzle than a central portion thereof; and wherein an obstacle for obstructing a flow of solid fuel and transporting air ejected from said fuel nozzle and a flow of air ejected from said outside air nozzle is provided at a downstream end of a separation wall separating said fuel nozzle and said outside air nozzle.

4. A solid fuel burner according to claim 3, wherein a member is placed in said fuel nozzle, said member having a first portion contracting a cross-sectional area of a flow passage of said fuel nozzle toward a downstream side and a second portion expanding the cross-sectional area of said flow passage toward a further downstream side, and said additional air nozzle is provided at a portion of said flow passage that has a constant cross-sectional area downstream of said second portion of said member.

5. A solid fuel burner according to claim 4, wherein said member is a spindle-shaped obstacle smoothly contracting the flow passage cross-sectional area from a radial center of said flow passage toward the downstream side and expanding the flow passage cross-sectional toward the further downstream.

6. A solid fuel burner comprising:

a fuel nozzle for ejecting a mixed fluid of a solid fuel and a transporting gas having an oxygen concentration lower than an oxygen concentration of air;

an outside air nozzle for ejecting a combustion gas which is burnt with said fuel from an exit of said solid fuel burner, said outside air nozzle being arranged outside of said fuel nozzle;

portions contracting and expanding a flow passage inside said fuel nozzle; and an additional air nozzle for ejecting the combustion gas into said fuel nozzle in a direction nearly perpendicular to a flow direction of said mixed fluid inside said fuel nozzle and a separator dividing a flow passage inside said fuel nozzle, outlets of said additional air nozzle being placed at a position that the outlets overlap said separator when viewed in a direction perpendicular to the fuel jet flow direction at the separator, and said fuel nozzle having a constant area from a downstream end of said separator to the outlet of said fuel nozzle, wherein an obstacle for obstructing a flow of solid fuel and transporting air ejected from said fuel nozzle and a flow of the combustion gas ejected from said outside air nozzle is provided at a downstream end of a separation wall separating said fuel nozzle and said outside air nozzle.

7. A combustion apparatus including a solid fuel burner comprising:

a fuel nozzle for ejecting a mixed fluid of a solid fuel and a transporting gas having an oxygen concentration lower than an oxygen concentration of air;

an outside air nozzle for ejecting a combustion gas which is burnt with said fuel from an exit of said solid fuel burner, said outside air nozzle being arranged outside of said fuel nozzle;

portions contracting and expanding a flow passage inside said fuel nozzle; and an additional air nozzle for ejecting the combustion gas into said fuel nozzle in a direction nearly perpendicular to a flow direction of said mixed fluid inside said fuel nozzle and a separator dividing a flow passage inside said fuel nozzle, outlets of said additional air nozzle being placed at a position that the outlets overlap said separator when viewed in a direction perpendicular to the fuel jet flow direction at the separator, and said fuel nozzle having a constant area from a downstream end of said separator to the outlet of said fuel nozzle, wherein an obstacle for obstructing a flow of solid fuel and transporting air ejected from said fuel nozzle and a flow of the combustion gas ejected from said outside air nozzle is provided at a downstream end of a separation wall separating said fuel nozzle and said outside air nozzle.

* * * * *